US008072394B2

(12) United States Patent
Ludden et al.

(10) Patent No.: US 8,072,394 B2
(45) Date of Patent: Dec. 6, 2011

(54) VIDEO DISPLAY DRIVER WITH DATA ENABLE LEARNING

(75) Inventors: Christopher A. Ludden, Pittsford, NY (US); John S. Childs, Rochester, NY (US)

(73) Assignee: National Semiconductor Corporation, Santa Clara, CA (US)

( * ) Notice: Subject to any disclaimer, the term of this patent is extended or adjusted under 35 U.S.C. 154(b) by 861 days.

(21) Appl. No.: 12/128,132

(22) Filed: May 28, 2008

(65) Prior Publication Data

US 2008/0303750 A1 Dec. 11, 2008

Related U.S. Application Data

(60) Provisional application No. 60/932,910, filed on Jun. 1, 2007.

(51) Int. Cl.
*G09G 3/20* (2006.01)

(52) U.S. Cl. ..... 345/55; 345/204; 345/213; 345/99; 345/100; 345/87

(58) Field of Classification Search ..... 345/99, 345/100, 98, 204, 502, 537, 87, 212, 213
See application file for complete search history.

(56) References Cited

U.S. PATENT DOCUMENTS

| | | | | |
|---|---|---|---|---|
| 5,828,368 | A * | 10/1998 | Jung | 345/213 |
| 6,577,322 | B1 * | 6/2003 | Fukuda | 345/698 |
| 6,670,964 | B1 * | 12/2003 | Ward et al. | 345/660 |
| 6,822,660 | B2 * | 11/2004 | Kim | 345/699 |
| 6,927,746 | B2 | 8/2005 | Lee et al. | |
| 6,954,491 | B1 * | 10/2005 | Kim et al. | 375/220 |
| 7,554,534 | B2 * | 6/2009 | Takaki et al. | 345/204 |
| 7,830,450 | B2 * | 11/2010 | Gong et al. | 348/459 |
| 2003/0193462 | A1 * | 10/2003 | Matsumura | 345/87 |
| 2005/0083290 | A1 * | 4/2005 | Katagawa et al. | 345/100 |
| 2007/0200836 | A1 * | 8/2007 | Jung | 345/204 |

FOREIGN PATENT DOCUMENTS

| | | |
|---|---|---|
| JP | 2007-033659 | 2/2007 |
| JP | 2007-041437 | 2/2007 |
| KR | 10-2006-0077207 | 7/2006 |

OTHER PUBLICATIONS

International Preliminary Report on Patentability (IPRP) corresponding to International Patent Application No. PCT/US2008/065065, International Bureau of WIPO, Dec. 1, 2009; 5 pgs.
German Search Report corresponding to co-pending German Patent Application No. 10 2008 025 915.2, German Patent Office, dated Feb. 10, 2009, 4 pages.
International Search Report for International Application No. PCT/US08/65065 dated Nov. 4, 2008, 3 pp.
Written Opinion for International Application No. PCT/US08/65065 dated Nov. 4, 2008, 2 pp.

(Continued)

*Primary Examiner* — Alexander S Beck
*Assistant Examiner* — Amen Bogale
(74) *Attorney, Agent, or Firm* — Vedder Price PC

(57) ABSTRACT

Data enable learning is provided for a video display driver in which a data enable signal and pixel clock exclusive of their associated horizontal and vertical synchronization signals for a digital video signal are used to facilitate generating of signals corresponding to the associated horizontal and vertical synchronization signals.

8 Claims, 26 Drawing Sheets

OTHER PUBLICATIONS

U.S. Appl. No. 12/128,155, filed May 28, 2008, entitled Video Display Driver With Partial Memory Control.
U.S. Appl. No. 12/128,169, filed May 28, 2008, entitled Video Display Driver With Gamma Control.
Korean Non-Final Office Action (w/translation) corresponding to co-pending Korean Patent Application No. 10-2008-7018483, Korean Intellectual Properaty Office, Dec. 2009,8 pgs.

* cited by examiner

| GREY LEVEL | OUTPUT VOLTAGES CURVE 00 | CURVE 01 | CURVE 10 | CURVE 11 | | |
|---|---|---|---|---|---|---|
| 0 | | | | | | V0 |
| 1 | 11.2% | 12.4% | 39.0% | 9.6% | of (V7-V0) | + V0 |
| 2 | 24.5% | 22.0% | 50.0% | 22.7% | of (V7-V0) | + V0 |
| 3 | 39.9% | 41.2% | 60.0% | 38.8% | of (V7-V0) | + V0 |
| 4 | 53.4% | 57.2% | 69.0% | 55.0% | of (V7-V0) | + V0 |
| 5 | 68.9% | 73.2% | 79.0% | 70.8% | of (V7-V0) | + V0 |
| 6 | 84.5% | 87.6% | 90.0% | 83.9% | of (V7-V0) | + V0 |
| 7 | | | | | | V7 |
| 8 | 8.4% | 8.8% | 7.9% | 7.4% | of (V24-V7) | + V7 |
| 9 | 18.1% | 18.2% | 15.7% | 14.7% | of (V24-V7) | + V7 |
| 10 | 23.7% | 24.2% | 24.4% | 20.6% | of (V24-V7) | + V7 |
| 11 | 32.0% | 30.8% | 31.5% | 27.9% | of (V24-V7) | + V7 |
| 12 | 38.9% | 36.8% | 38.6% | 33.8% | of (V24-V7) | + V7 |
| 13 | 45.9% | 42.8% | 45.7% | 39.7% | of (V24-V7) | + V7 |
| 14 | 51.4% | 48.2% | 51.2% | 47.1% | of (V24-V7) | + V7 |
| 15 | 57.0% | 53.5% | 55.9% | 52.9% | of (V24-V7) | + V7 |
| 16 | 62.5% | 58.8% | 63.0% | 58.9% | of (V24-V7) | + V7 |
| 17 | 68.1% | 64.8% | 67.7% | 64.7% | of (V24-V7) | + V7 |
| 18 | 72.3% | 71.5% | 73.2% | 70.6% | of (V24-V7) | + V7 |
| 19 | 77.8% | 75.5% | 78.7% | 75.0% | of (V24-V7) | + V7 |
| 20 | 81.9% | 78.8% | 82.7% | 80.9% | of (V24-V7) | + V7 |
| 21 | 86.2% | 83.5% | 87.4% | 86.8% | of (V24-V7) | + V7 |
| 22 | 90.4% | 88.8% | 91.3% | 91.2% | of (V24-V7) | + V7 |
| 23 | 95.8% | 94.2% | 96.9% | 95.6% | of (V24-V7) | + V7 |
| 24 | | | | | | V24 |
| 25 | 3.3% | 2.8% | 4.1% | 3.5% | of (V56-V24) | + V24 |
| 26 | 5.5% | 4.9% | 6.8% | 7.0% | of (V56-V24) | + V24 |
| 27 | 8.8% | 7.6% | 11.6% | 10.4% | of (V56-V24) | + V24 |
| 28 | 12.1% | 10.3% | 13.7% | 14.0% | of (V56-V24) | + V24 |
| 29 | 15.5% | 14.5% | 17.1% | 17.5% | of (V56-V24) | + V24 |

FIG. 20A

FIG. 20B

FIG. 20A

| | | | | | | |
|---|---|---|---|---|---|---|
| 30 | 18.7% | 17.2% | 19.9% | 19.7% | of (V56-V24) | + V24 |
| 31 | 22.0% | 20.9% | 23.3% | 23.3% | of (V56-V24) | + V24 |
| 32 | 24.3% | 23.6% | 26.7% | 26.8% | of (V56-V24) | + V24 |
| 33 | 27.5% | 26.3% | 30.1% | 29.0% | of (V56-V24) | + V24 |
| 34 | 30.8% | 29.5% | 32.2% | 32.6% | of (V56-V24) | + V24 |
| 35 | 32.9% | 31.6% | 35.6% | 36.1% | of (V56-V24) | + V24 |
| 36 | 36.3% | 34.8% | 38.4% | 38.3% | of (V56-V24) | + V24 |
| 37 | 39.6% | 37.5% | 41.1% | 41.9% | of (V56-V24) | + V24 |
| 38 | 42.9% | 40.7% | 45.2% | 44.2% | of (V56-V24) | + V24 |
| 39 | 45.1% | 43.3% | 47.9% | 47.6% | of (V56-V24) | + V24 |
| 40 | 48.4% | 46.0% | 50.7% | 50.0% | of (V56-V24) | + V24 |
| 41 | 51.7% | 49.2% | 53.4% | 53.5% | of (V56-V24) | + V24 |
| 42 | 53.9% | 51.9% | 56.8% | 55.8% | of (V56-V24) | + V24 |
| 43 | 57.2% | 55.1% | 59.6% | 59.3% | of (V56-V24) | + V24 |
| 44 | 60.5% | 57.2% | 62.3% | 61.7% | of (V56-V24) | + V24 |
| 45 | 63.8% | 60.4% | 65.1% | 65.1% | of (V56-V24) | + V24 |
| 46 | 66.0% | 63.6% | 67.8% | 67.5% | of (V56-V24) | + V24 |
| 47 | 69.3% | 66.3% | 71.2% | 71.0% | of (V56-V24) | + V24 |
| 48 | 72.6% | 69.5% | 74.7% | 73.3% | of (V56-V24) | + V24 |
| 49 | 75.8% | 72.7% | 77.4% | 76.8% | of (V56-V24) | + V24 |
| 50 | 79.1% | 75.3% | 80.1% | 80.3% | of (V56-V24) | + V24 |
| 51 | 82.4% | 78.5% | 83.6% | 82.6% | of (V56-V24) | + V24 |
| 52 | 85.7% | 81.7% | 86.3% | 86.1% | of (V56-V24) | + V24 |
| 53 | 89.0% | 84.9% | 89.7% | 89.6% | of (V56-V24) | + V24 |
| 54 | 92.4% | 88.7% | 93.2% | 93.0% | of (V56-V24) | + V24 |
| 55 | 96.7% | 94.5% | 97.3% | 96.5% | of (V56-V24) | + V24 |
| 56 | | | | | | V56 |
| 57 | 11.9% | 4.5% | 5.6% | 6.9% | of (V63-V56) | + V56 |
| 58 | 23.5% | 8.5% | 12.1% | 11.9% | of (V63-V56) | + V56 |
| 59 | 35.4% | 16.5% | 19.6% | 20.4% | of (V63-V56) | + V56 |
| 60 | 47.0% | 24.5% | 28.0% | 27.1% | of (V63-V56) | + V56 |
| 61 | 61.8% | 31.8% | 37.4% | 37.3% | of (V63-V56) | + V56 |
| 62 | 79.3% | 50.5% | 50.5% | 54.2% | of (V63-V56) | + V56 |
| 63 | | | | | | V63 |

FIG. 20B

NOTE 1: THE RED GAMMA VALUES ARE MAPPED FROM SEVEN REGISTERS.
NOTE 2: GREEN AND BLUE GAMMA VALUES ARE NOT SHOWN.
NOTE 3: GAMMA SELECT MAY BE DIFFERENT FOR R, G AND B.

VIDEO DISPLAY DRIVER WITH DATA ENABLE LEARNING

RELATED APPLICATIONS

This application claims priority from U.S. Provisional Patent Application No. 60/932,910, filed on Jun. 1, 2007, the contents of which are incorporated herein by reference.

BACKGROUND

Liquid Crystal Displays (LCDs) are used in a variety of products, including cell phone, digital music players, personal digital assistants, web browsing devices, and smart phones such as the announced Apple I-phone that combines one or more of the foregoing into a single, hand-held apparatus. Other uses are in hand-held games, hand-held computers, and laptop/notebook computers. These displays are available in both gray-scale (monochrome) and color forms, and are typically arranged as a matrix of intersecting rows and columns. The intersection of each row and column forms a pixel, or dot, the density, and/or color of which can be varied in accordance with the voltage applied to the pixel in order to define the gray shades of the liquid crystal display. These various voltages produce the different shades of color on the display, and are normally referred to as "shades of gray" even when speaking of a color display.

The image displayed on the screen may be controlled by individually selecting one row of the display at a time, and applying control voltages to each column of the selected row. The period during which each such row is selected may be referred to as a "row drive period." This process is carried out for each individual row of the screen; for example, if there are 480 rows in the array, then there are typically 480 row drive periods in one display cycle. After the completion of one display cycle during which each row in the array has been selected, a new display cycle begins, and the process is repeated to refresh and/or update the displayed image. Each pixel of the display is periodically refreshed or updated many times each second, both to refresh the voltage stored at the pixel as well as to reflect any changes in the shade to be displayed by such pixel over time.

Liquid crystal displays used in computer screens require a relatively large number of such channel driver outputs. Channel drivers are connected to a source terminal of a thin film resistor that is fabricated onto the glass of the LCD. Many smaller display devices, including cameras, cell phones and personal digital assistants, have sensors that detect the orientation of the display. Such devices may change the view from portrait format to landscape format, depending upon the orientation of the device. Columns, which are vertical, become horizontal during landscape orientation. However, the same structure (the column) is still the driven structure, even though it assumes the orientation of a row. In order to avoid confusion, this patent shall refer to "channel driver" and that shall mean the structure for driving the source terminal of the thin film pass transistor.

Color displays typically require three times as many channel drivers as conventional "monochrome" LCD displays; such color displays usually require three columns per pixel, one for each of the three primary colors to be displayed. The channel driver circuitry is typically formed upon monolithic integrated circuits. Integrated circuits serve as channel drivers for active matrix LCD displays and generate different output voltages to define the various "gray shades" on a liquid crystal display. These varying analog output voltages vary the shade of the color that is displayed at a particular point, or pixel, on the display. The channel driver integrated circuit must drive the analog voltages onto the columns of the display matrix in the correct timing sequence.

LCDs are able to display images because the optical transmission characteristics of liquid crystal material change in accordance with the magnitude of the applied voltage. However, the application of a steady DC voltage to a liquid crystal will, over time, permanently change and degrade its physical properties. For this reason, it is common to drive LCDs using drive techniques which charge each liquid crystal with voltages of alternating polarities relative to a common midpoint voltage value. It should be noted that, in this context, the "voltages of alternating polarities" does not necessarily require the use of driving voltages that are greater than, and less than, ground potential, but simply voltages that are above and below a predetermined median display bias voltage. The application of alternating polarity voltages to the pixels of the display is generally known as inversion.

Accordingly, driving a pixel of liquid crystal material to a particular gray shade involves two voltage pulses of equal magnitude but opposite polarity relative to the median display bias voltage. The driving voltage applied to any given pixel during its row drive period of one display cycle is typically reversed in polarity during its row drive period on the next succeeding display cycle. The pixel responds to the RMS value of the voltage so the final "brightness" of the pixel only depends on the magnitude of the voltage and not the polarity. The alternating polarity is used to prevent "polarization" of the LC material due to impurities.

BRIEF DESCRIPTION OF THE DRAWINGS

Note: FIGS. 1-12 and 13-17 employ independent sets of numeric designators for their respective elements in these drawings. Accordingly, while it may otherwise appear that some duplication occurs, all references to drawing elements should be read in context.

FIG. 2 is a block diagram of a display driver according to an embodiment of the present invention.

FIG. 3 depicts operation of the LoSSI interface of FIG. 2.

FIG. 4 is a block diagram of the MPL interface of FIG. 1B.

FIG. 5 is a diagram of five configurations of RAM data according to an embodiment of the present invention.

FIG. 6 depicts operations involving the RAM of FIG. 2 according to an embodiment of the present invention.

FIG. 7 depicts operations for the DE Learning element of FIG. 2 according to an embodiment of the present invention.

FIG. 8 is a timing diagram of signals involved in operations for the DE learning element of FIG. 2 according to an embodiment of the present invention.

FIG. 9 is a timing diagram of further signals involved in operations for the DE learning element of FIG. 2 according to an embodiment of the present invention.

FIG. 10 depicts operations involving the Alpha Blend element of FIG. 2 according to an embodiment of the present invention.

FIG. 11 illustrates a display with an image within a window when a display driver is operated in a partial mode according to an embodiment of the present invention.

FIG. 12 depicts operations for a power down mode, termination of video mode and expiration of time for displaying video according to an embodiment of the present invention.

FIG. 13 is a partial block diagram of the source driver block.

FIG. 14 is a schematic of the output channels in the source driver block.

FIG. 16 shows how pixels are packed in the three-bit mode.

FIG. 17 is graphical illustration of an exemplary gamma curve.

FIG. 20 is a table of values for gamma curves according to an embodiment of the present invention.

DETAILED DESCRIPTION

Figure 1A:
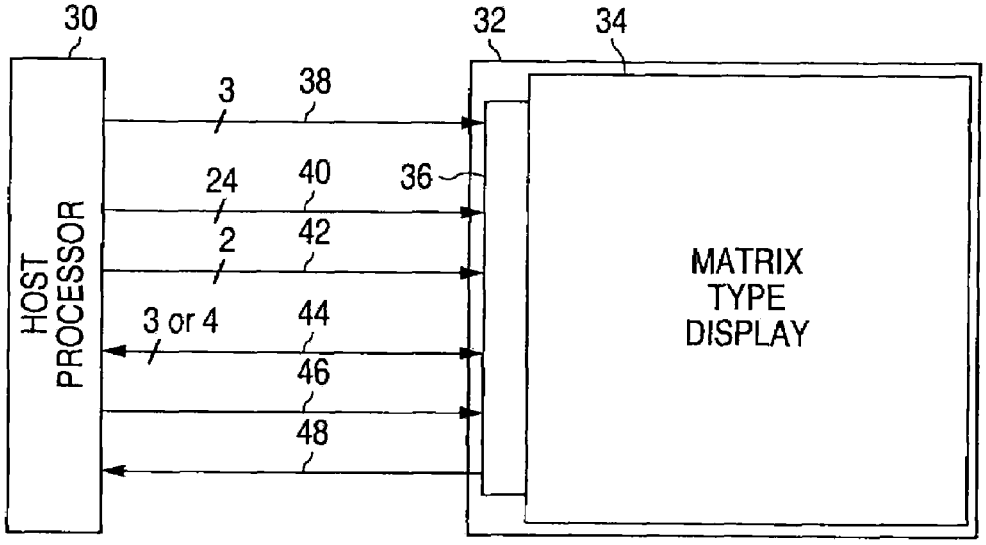
FIG. 1A is a block diagram showing direct video data connections from a host processor to a matrix type of display according to one embodiment of the present invention.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled to provide a desired function. The term "signal" means at least one current, voltage, charge, temperature, data, or other signal.

The term "channel" identifies the circuit elements that receive digital data and convert the received digital data into analog voltages that are applied to the pad locations on a glass substrate. The pads are connected to source terminals of thin film transistors. The term "line" refers to a set of adjacent channel pixels that are connected to a common gate signal. All the gates of adjacent thin film transistors in a line are connected to a common gate signal. One line is selected for receiving data when its gate signal turns on the transistors in the line. In a first orientation of the display, the output channels are columns and the lines are rows. When the display is rotated ninety degrees to a second orientation, the columns become rows and the lines become columns. The following text assumes the display is always in the first orientation and the terms columns and channels are interchangeable as are the terms line and row. Those skilled in the art understand that in the second orientation, the "lines" are still the output channels and the "columns" are selected by the gate driver.

Also, the discussion below uses a number of terms for which definitions are provided as follow:

Normal Mode: This is the display mode in which streaming video data is sent to the display. In this mode, timing is derived from the PCLK and DE signals that are received through the video interface. The Partial Display Memory is not used in this mode.

Partial Mode: This is the display mode in which data is read from the internal Partial Display Memory and sent to the display. Timing to the display is specified by register settings and is derived from an internal oscillator.

Alpha Mode: This is the display mode in which image data stored in the Partial Display Memory is blended with (or overlain on) the incoming video data. Timing is derived from the PCLK and DE signals that are received through the video interface.

Partial Display Memory: On-chip memory which is used to store display data for the Partial Display Window.

Partial Display Window: A user-defined region on the display that is self-refreshed with image data stored in the Partial Display Memory when the device is operating in Partial Mode.

Color Mode: The Color Mode determines the bit depth of the data that is sent to the display, and is distinguishable from Packing Mode in that several different "packing schemes" could be used for a given Color Mode. For example, in Partial Mode, the BITS_PER_PIXEL register may be used to select one of the Color Modes:

- 1-Bit Mode: Each pixel is rendered using 1 bit (2 levels). The same data value is used for the red, green and blue subpixels. The source driver drive voltages can be adjusted to define a foreground color for the data=1 condition and a background color for the data=0 condition. The foreground and background colors are not limited to black/white values.
- 3-Bit Mode: Each pixel is rendered using 1 bit of data (2 levels) for each of the red, green and blue subpixels. The source driver drive voltages can be adjusted to define an 8-color palette which is not limited to the conventional B, W, R, G, B, C, Y, M colors.
- 3-Bit Mode LP: Lower system power and reduced LoSSI write speed. Otherwise identical to the 3-Bit Mode.
- 12-Bit Mode: Each pixel is rendered using 4 bits (16 levels) for each of the red, green and blue subpixels.
- 18-Bit Mode: Each pixel is rendered using 6 bits (64 levels) for each of the red, green and blue subpixels.

In Normal Mode, the output color mode is 24/18-Bit, regardless of the value of the BITS_PER_PIXEL register or of the PM Color Set command state.

Packing Mode: As data is written to the Partial Display Memory via the serial interface, it is packed according to the bit-depth that will be used when displaying the Partial Display Memory data (BITS_PER_PIXEL register). Five packing modes are provided (see FIG. 5):

- 1-Bit Packing: Each byte sent over the serial interface contains six pixels.
- 3-Bit Packing: Each byte sent over the serial interface contains two pixels.

3-Bit Efficient Packing: Every three bytes sent over the serial interface contain eight pixels.

12-Bit Packing: Every two bytes sent over the serial interface contain one pixel.

18-Bit Packing: Every three bytes sent over the serial interface contain one pixel.

Configuration Registers: Registers which control the operating modes and settings which effect driver behavior.

Register Access Mode: This mode allows the Serial Interface to directly access the Configuration Register settings. The host CPU directly controls the settings of the Configuration Registers in this mode. Alternatively, the device can be controlled via the Command Mode. Register Access Mode is entered by sending the Enter Register Access Mode command.

Command Mode: This mode provides a method of controlling the display operation using high-level OpCodes. Each OpCode loads an associated set of Configuration Register values from an internal EEPROM. Thus, the host CPU need not have knowledge of the Configuration Registers. Alternatively, the device can be controlled via Register Access Mode. Command Mode may be entered by sending the Enter Command Mode command or by writing any data to register address 5Fh. After a reset, the FPD95120 is in the Command Mode.

Low-Speed Serial Interface (LoSSI) Protocols:

SPI Protocol: Traditional SPI-like serial interface protocol which contains a Read/Write bit, 7-bit address field, and 8-bit data field. If used in Command Mode transactions, the R/W-bit plus address field is replaced by an 8-bit command and the data field(s) is optional.

TSI Protocol: Serial interface protocol which contains a Cmd/Data bit, 8-bit command (or address) field, and optional 8-bit data field(s).

With respect to the drawings, FIG. 1A is a block diagram showing direct video data connections from a host processor 30 to a display board 32 having a matrix type of display 34, such as an LCD display, and a display driver 36 which passes image data from the host processor 30 to the display driver 36 according to one embodiment of the present invention. Two power supply voltages and ground are provided by the host processor 30 to the display driver 36 on three lines of a bus 38. Video or RGB (red, green, and blue) data is provided on 24 lines on a bus 40 thus enabling the parallel transfer of up to 24 bit pixel data (8 bits per subpixel). Also transferred are two signals on bus 42, Pclk and DE, which are synchronized by the host computer 30 to the video data. Three or four lines on bus 44 provide a low-speed serial interface (LoSSI) between the host processor 30 and the display adapter 36, which is one embodiment, is either encoded according to the Serial Peripheral Interface (SPI) or the Three Wire Serial Interface (TSI). A reset line 46 to reset the display driver 36 by the host processor 30, and a video transfer timing signal on line 48 from the display driver 36 to the host processor 30 are also shown in FIG. 1A. The video transfer timing signal transitions between high and low at the time that selected lines are being written into the display 34 in order for the host processor to update the partial memory RAM 82 without displaying parts of two images at the same time on the display 34.

Figure 1B:
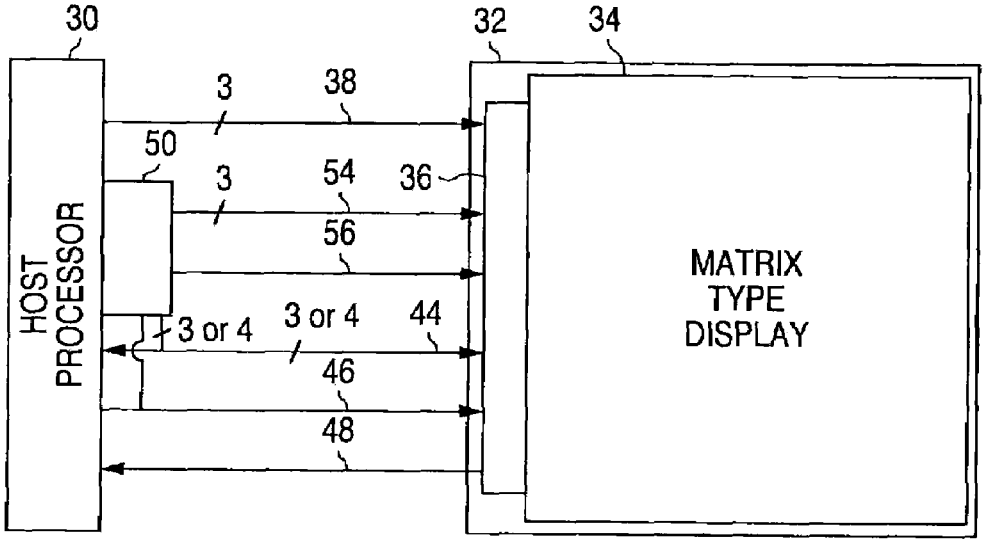
FIG. 1B is a block diagram showing a serially encoded video data connection from the host processor to the display thorough a Mobile Pixel Link (MPL) interface according to another embodiment of the present invention.

FIG. 1B is a block diagram showing a serially encoded video data connection from the host processor 30 to the display driver 36 thorough a Mobile Pixel Link (MPL) interface circuit 50 which receives parallel video data from the host processor, converts it to high-speed serial data, and places it on the 3 line MPL data bus 54 along with an MPL power down signal on line 56 according to another embodiment of the present invention. The 3 line MPL data bus 54 consists of a two differential signal pair and a clock line. The other wires and buses, 38, 44, 46, and 48, are also shown in FIG. 1B. The MPL interface circuit 50 is also connected to the 3 or 4 wire low-speed serial interface 44 and to the reset line 46.

Figure 2:
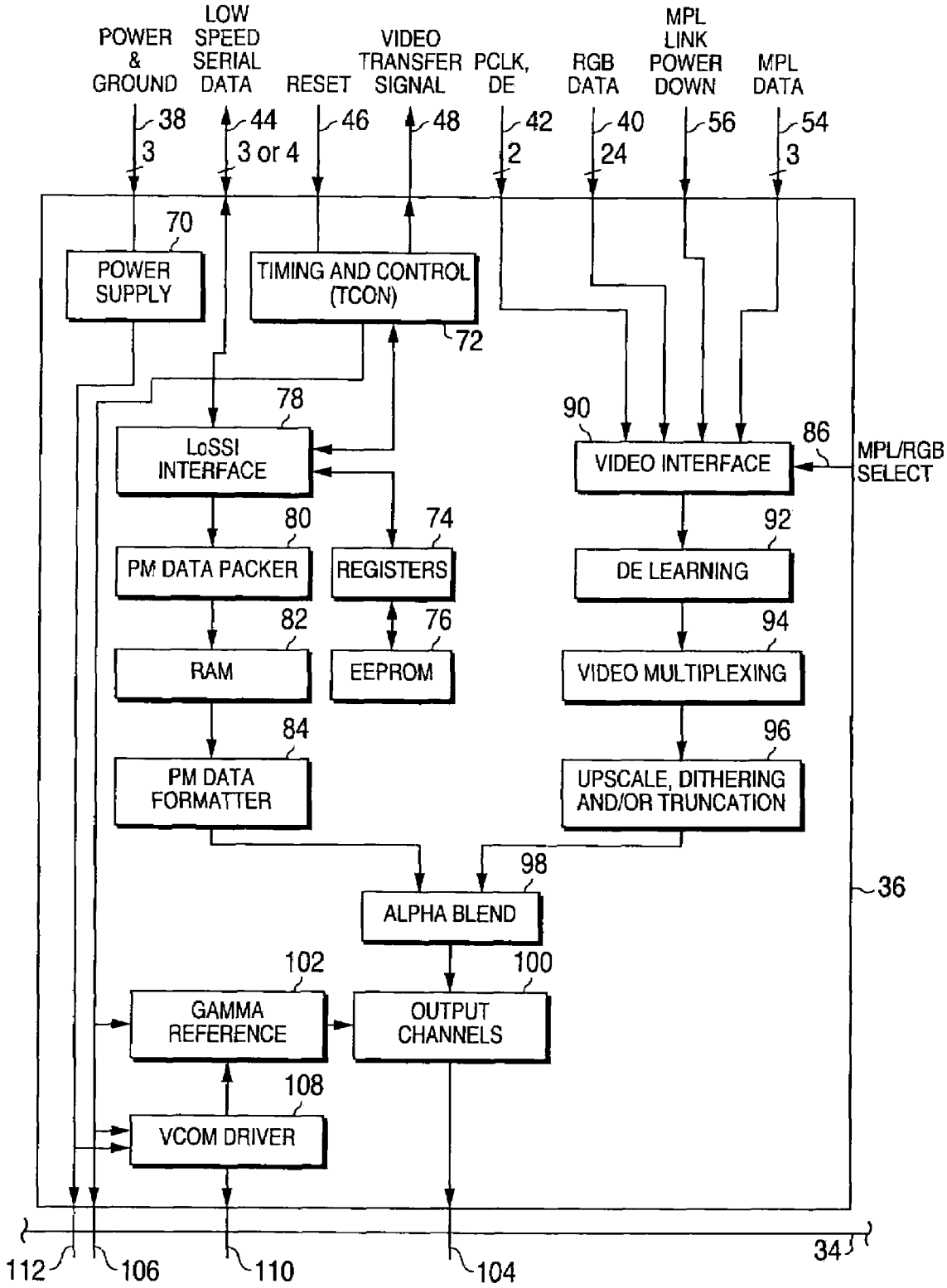

FIG. 2 is a block diagram of the display driver 36 according to an embodiment of the present invention. The display driver 36 includes a power supply 70 which receives 2 power supply voltages and ground on bus 38 and provides various supply voltages to the rest of the display driver 36 and to the display 34. Some of the voltages produced by the power supply 70 depend on the characteristics of the display 34 and other operating conditions set by the host processor 30 shown in FIGS. 1A and 1B. The display driver 36 also includes a timing and control block 72 which generates the timing signals used in the display driver 36 and, depending on the register settings in the registers 74 and the mode in which the display driver 36 is operating, provides the necessary control signals to the rest of the display driver 36. The registers 74 are coupled to an EEPROM 76 which holds certain nonvolatile data such as the settings for the various registers 74 when the display driver 36 is first powered up and after being reset. The EEPROM 76 also holds a plurality of user set combinations of register settings so that the display driver 36 can be switched to one of these stored combinations of register settings with a single command rather than having to directly enter each of the desired registered settings. When the display driver 36 receives a command to switch to one of the stored combinations of register settings, the setting stored in the EEPROM 76 are transferred to the appropriate registers 74.

The display driver 36 has a low-speed serial interface (LoSSI) 78 which interfaces with the data on bus 44 and processes the data as described below. Except for the reset command on line 46, the display driver 36 receives all of its operational commands, and sends data back to the host processor 30 through the LoSSI interface 78. As described in more detail below, the display driver 36 has two basic operating configurations, a command mode and a register mode. When operating in the command mode, commands received at the LoSSI interface 78 are passed to the timing and control block 72, and when operating in the register mode, register writes are made to the selected registers 74.

The LoSSI interface 78 is used to pass image data for use when the display driver 36 is in the partial mode or in the alpha mode, both of which are described in more detail below. The PM data packer 80 receives partial memory data from the LoSSI interface 78, strips the data of unused bits, and passes the remaining data to the RAM 82 as described in more detail below. When the image stored in the RAM is to be displayed, a partial memory (PM) data formatter 84 formats the data depending on the format of the data stored in the RAM and the operating mode of the display driver 36 which is described in detail below.

The normal video data can be received by the display driver 36 as 24 bits per pixel data on bus 40 together with the clock timing signal, Pclk, and the data enable signal, DE, on bus 42. Alternatively, the display driver 36 can receive normal video data encoded according to the MPL standard on the three wire high-speed serial data bus 54 together with an MPL link power down signal of line 56. Which mode the display driver 36 is set to receive the normal video data is determined by a wire jumper on the display board 32 as indicated by line 86 in FIG. 2.

A video interface 90 receives the normal video data, decodes the MPL data if the video data is sent over the MPL link, and converts the pixel data to 24 bits per pixel if the incoming video data is 18 or 16 bit pixel data according to algorithms known by those skilled in the art. The 24 bit pixel data is then passed to a DE learning block 92 which generates a substitute DE signal for the rest of the display driver 36 and in so doing essentially digitally filters the DE incoming signal so that virtually all erroneous transitions in the DE incoming signal are corrected as described below in more detail. The DE learning block 92 also detects the vertical blanking time which enables the display driver 36 to operate without receiving horizontal sync or vertical sync signals from the video source since the DE learning block 92 generates the substitute DE signal based only on the DE and Pclk signals.

The video data, after the DE learning process in block 92, is multiplexed into sets of two pixels (2-pixel sets) processed in parallel by a video multiplexor block 94 which requires an output bus 48 bits wide. This allows the pixel data to be processed at half the data rate of the incoming video which eases the design layout requirements and lowers the power consumed by the display driver 36 since the transitions from one logic state to the other can be essentially twice as long.

After the incoming data has been arranged into 2-pixel sets by the video multiplexor 94, the 24 bit data of each pixel is converted to 18 bit data. If the incoming video data is 24 bits per pixel, the 24 bit data can be converted to 18 bits either by dithering or truncation of the two least significant bits of each color channel or subpixel (red, green, and blue) by the upscale, dithering and/or truncation block 96.

The display driver 36 has the ability to combine the video data with the data stored in the RAM 82 in the alpha blend block 98, the details of which are described in detail below. In addition to having the capability to blend the video data and the RAM 82 data, the alpha blend block 98 is also used when the display driver 36 is in a video upscale mode to double the size of the incoming video by mapping each incoming pixel into four output pixels.

The output from the alpha blend block 98 is coupled to a column driver or output channels 100 which, in combination with a gamma reference 102, produces the analog gray level voltages which are passed to the subpixels in the display 34 on a bus 104 as described in detail below. Since a very common type of matrix display is an LCD type of display, the description below will describe an LCD type of display to keep from unduly complicating the description, but it will be understood that the display driver 36 can be used with other types of matrix displays.

As is well known in the industry, the LCD display 34 is a matrix of polysilicon transistors (not shown), which receive the analog gray level voltages at their sources (hence the term "source driver") and are gated on and off on a line-by-line basis in sequential order. These signals are passed to the display 34 from the timing and control block 72 on a bus 106. As is also well known in the industry a Vcom voltage is used to adjust the voltage level across the liquid display elements (not shown) on a dot-by-dot basis, on a line-by-line basis, or an frame-by-frame basis and are generated in the Vcom driver block 108 and passed to the display 34 on a bus 110. The current polarity of the Vcom voltage is passed to the Gamma Reference 102 to synchronize the polarity switching of the Vcom voltage and the Gamma Reference voltage. The power supply voltages required by the display 34 and are passed to the display 34 on a bus 112.

Low Speed Serial Interface Protocols in Display Driver 36 and MPL Encoder 50

In general terms the display driver 36 is controlled by the contents of the registers 74, although the display driver 36 can be controlled by transactions sent over the low speed serial connection 44 which are decoded by the LoSSI interface 78 as either direct commands or as writes to the registers 74. Depending on the state of the registers 74, or in response to a direct command, the display driver 36 either stores partial mode data in the RAM 82, enters into one of several modes of operation or performs other miscellaneous actions such as providing status data back to the host processor over the low speed serial connection 44.

Figure 3:
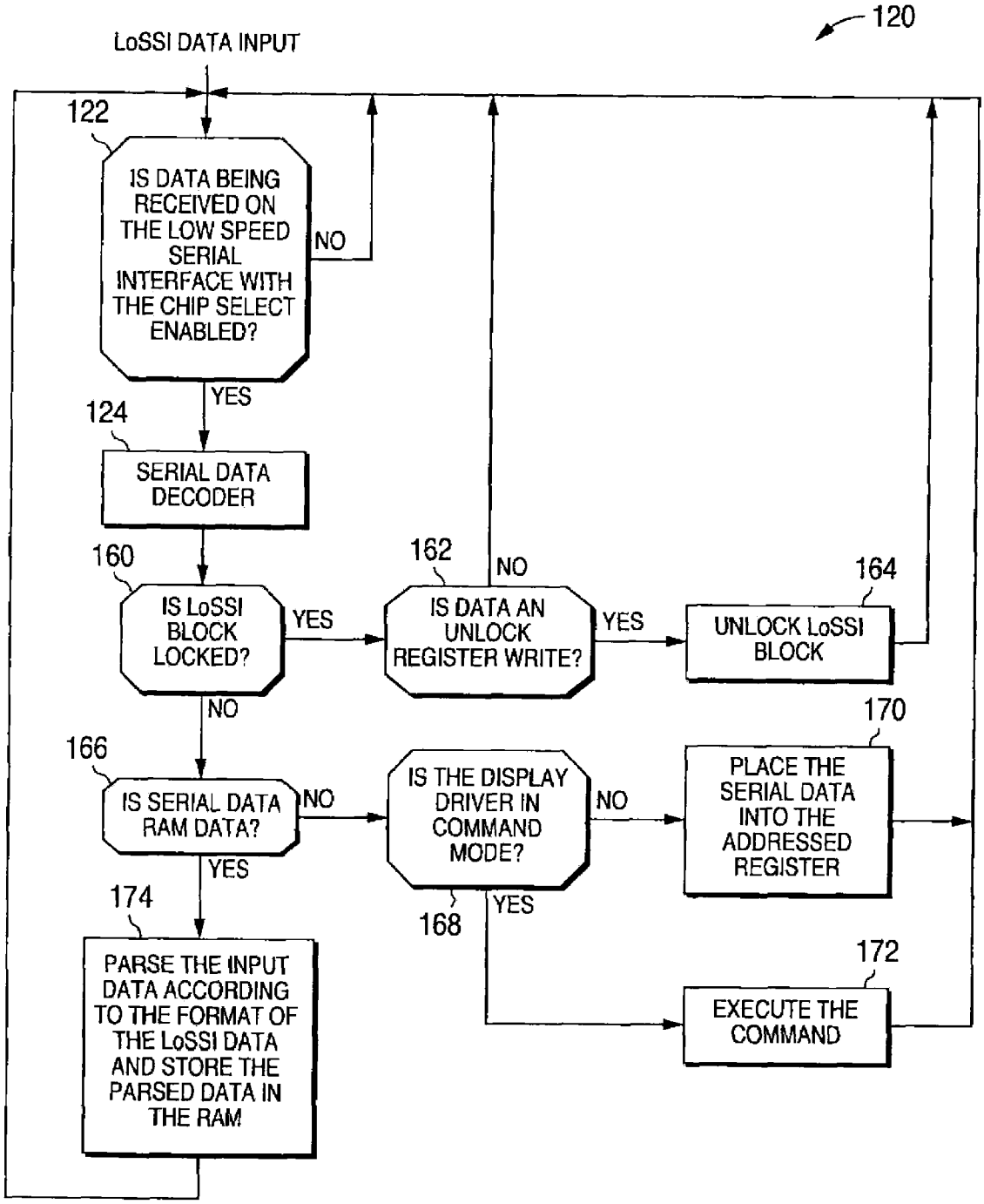

Turning now to FIG. 3, the flow of data into the LoSSI interface block 78 is shown in the flow diagram 120. As shown in FIG. 3 the LoSSI interface block 78 monitors the incoming serial data in step 122 ("Is data being received on the low speed serial interface with the chip select enabled?"). If the serial data bus is 3 wires (without a chip select line), the serial data is always decoded in step 124 ("Serial data decoder"). If the serial data connection is 4 wires (with a chip select line), the LoSSI interface block passes the serial data to the serial decoder step 124 only if the chip select line is enabled to the display driver 36 when the serial data is received by the LoSSI interface block 78.

The display driver 36 can receive serial data according to one of two different protocols, the serial peripheral interface (SPI) and the Three-Wire Serial Interface (TSI) which is essentially the same protocol as the SPI protocol but with an additional synchronization bit at the beginning of a single read or write, and with an additional "1" bit between successive 8 bit data blocks in a multiple write operation.

The LoSSI interface can be used in a system in which the display driver 36 receives serial data which may be sent also to another peripheral device using the same serial bus 44 which has the chip select signal. In this mode of operation, the display driver 36 has a LoSSI locked/unlocked register which holds data that disables (locks) the LoSSI interface 78 or enables (unlocks) the LoSSI interface 78. The host processor 30, if it is to send serial data to the display driver 36 switches the LoSSI interface from locked to unlocked, if necessary, by sending a predetermined register write command to the LoSSI locked/unlocked register in the register block 74. Conversely, if the host processor wants to send serial data to another peripheral device which shares the serial bus 44, the host processor must lock the LoSSI interface 78, if necessary, before communicating with the other peripheral device.

Figure 4:
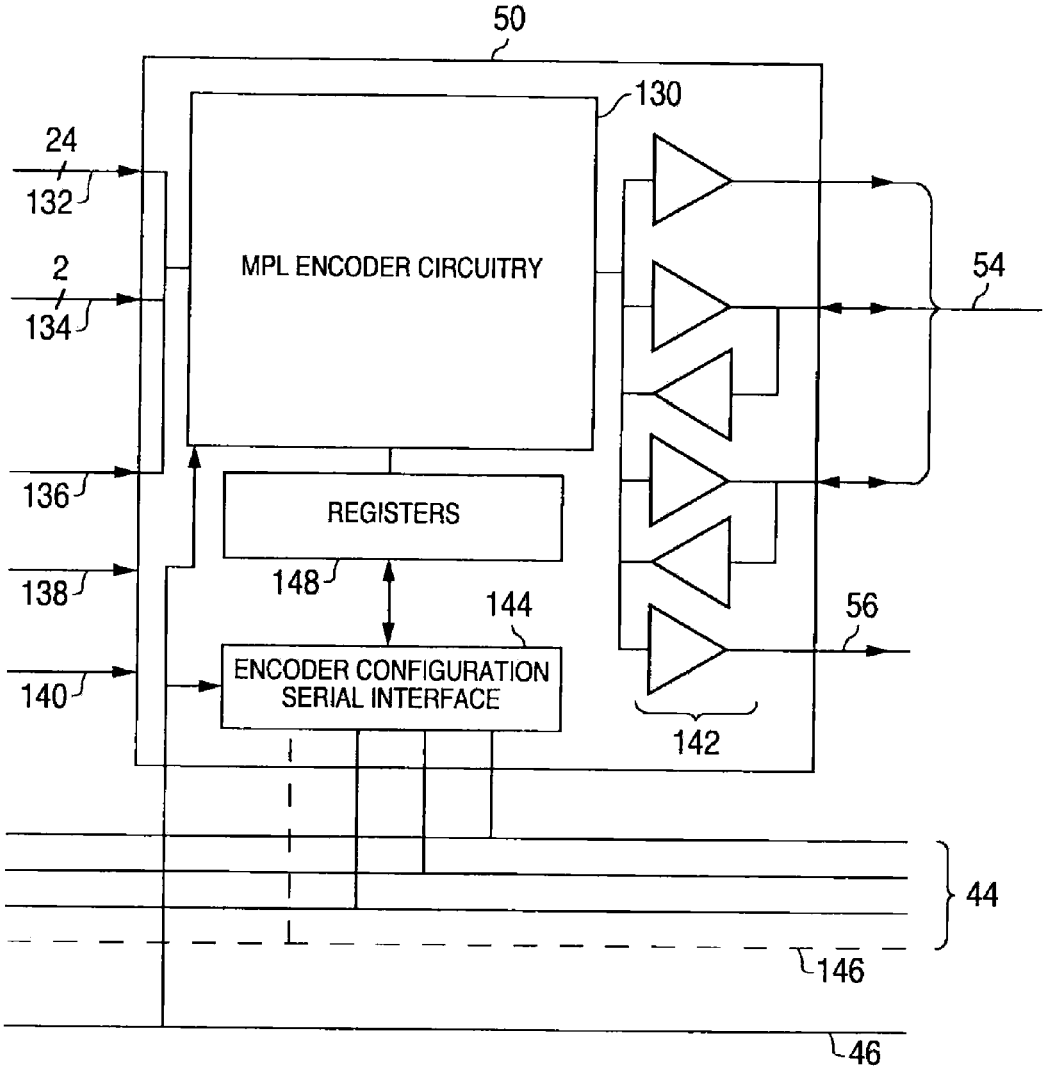

As shown in FIG. 1B, the MPL encoder 50 shares the same serial bus 44 with the display driver 36. FIG. 4 is a block diagram of the MPL encoder 50 which includes MPL encoder circuitry 130 that receives the 24 RGB lines on a bus 132, the Pclk and DE enable on a bus 134, the MPL power down signal on line 136, various other control and timing signals for controlling the MPL encoder 50 are on a bus 138, and power and ground are on a bus 140. As shown in FIG. 1B the MPL encoder 50 is connected to the display driver 36 by a three wire bus 54 and the MPL power down line 56 which couple signals to and from the display driver 36 by a plurality of line drivers and receivers 142. The MPL encoder 50 also includes an encoder configuration serial interface 144 which is connected to the three or four line low speed serial bus 44. The fourth line 146 is shown as a dashed line indicating that it is an optional line. With the fourth line 146 separate data in and data out lines are available rather than using a single data line for bidirectional data flow. The encoder configuration serial interface 144 is coupled to registers 148 which are used by the MPL encoder circuitry 130 to select the parameters of the operation of the MPL encoder 50.

Since the signals between the host processor 30 and the display driver 36 must pass through a hinged connection in a flip phone, it is desirable to keep the number of separate conductors to a minimum. The use of MPL encoder data and a three wire low speed serial interface helps to reduce the number of separate conductors to a minimum.

The encoder configuration interface 144, like the LoSSI interface 78, is in either a locked state meaning that all serial data is ignored except a command to write an unlock code to the registers 148, or in the unlocked state in which all incoming serial data is decoded if the chip select line 146, if present, is enabled, and is always decoded and processed if there is no chip select line 146. For simplicity, the lock and unlock control register for the display driver 36 and the MPL encoder 50 have the same address, and the lock/unlock code is the data in the registers enabling the host processor to write a first lock/unlock code which will unlock one of the display driver 36 or the MPL encoder 50 and also lock the other serial interface, or can send an lock/unlock code which will lock both serial interfaces in one embodiment of the invention. After the reset line 46 is activated, the display driver 36 will be in the unlocked state and the MPL encoder 50 will be in the locked state in one embodiment of the invention. Thus, when the display driver 36 is used without an MPL connection, the LoSSI interface 78 will be unlocked and ready to process serial data on the low speed serial data bus 44, and the host processor 30 will not have to write unlock data to the lock/unlock register.

Returning to FIG. 3 step 160 ("Is LoSSI block locked?") determines if the LoSSI interface 78 is locked or not, and if it is, the data is examined in step 162 ("Is data an unlock register write?") to see if it is an unlock code. If the data is not an unlock code, the LoSSI interface 78 ignores the serial data and waits for the next segment of serial data. If the data is an unlock code, the appropriate data is written into the lock/unlock register to unlock the LoSSI interface 78 in step 164 ("Unlock LoSSI block"), and the serial interface 78 waits for the next segment of serial data.

If the LoSSI interface is unlocked, the serial data is examined to determine if it is a write to the RAM 82 in step 166 ("Is serial data RAM data?"). If the serial data is not a write command to the RAM 82, the data is processed as a command or a register write depending on whether the display driver 36 is in the command mode or the register mode. Step 168 ("Is the display driver in command mode?") determines which of the two modes the display driver 36 is in, and if it is the register mode, the data is written to the addressed register as indicated in block 170 ("Place the serial data into the addressed register"). The addressed register may be the register that stores the command mode or register mode configuration data to the display driver 36, in which case, assuming that the serial data configures the display driver 36 into the command mode, the display driver 36 would switch to the command mode, and the LoSSI interface 78 would await the next segment of serial data. If the display driver 36 is in the command mode, the command is executed in step 172 ("Execute the command"). Similar to the register write which switches the display driver 36 to the command mode, the command being executed in block 172 may be a command to switch the display driver 36 to the register mode.

Partial Memory Image Data Transfer into the RAM 82

Figure 5:
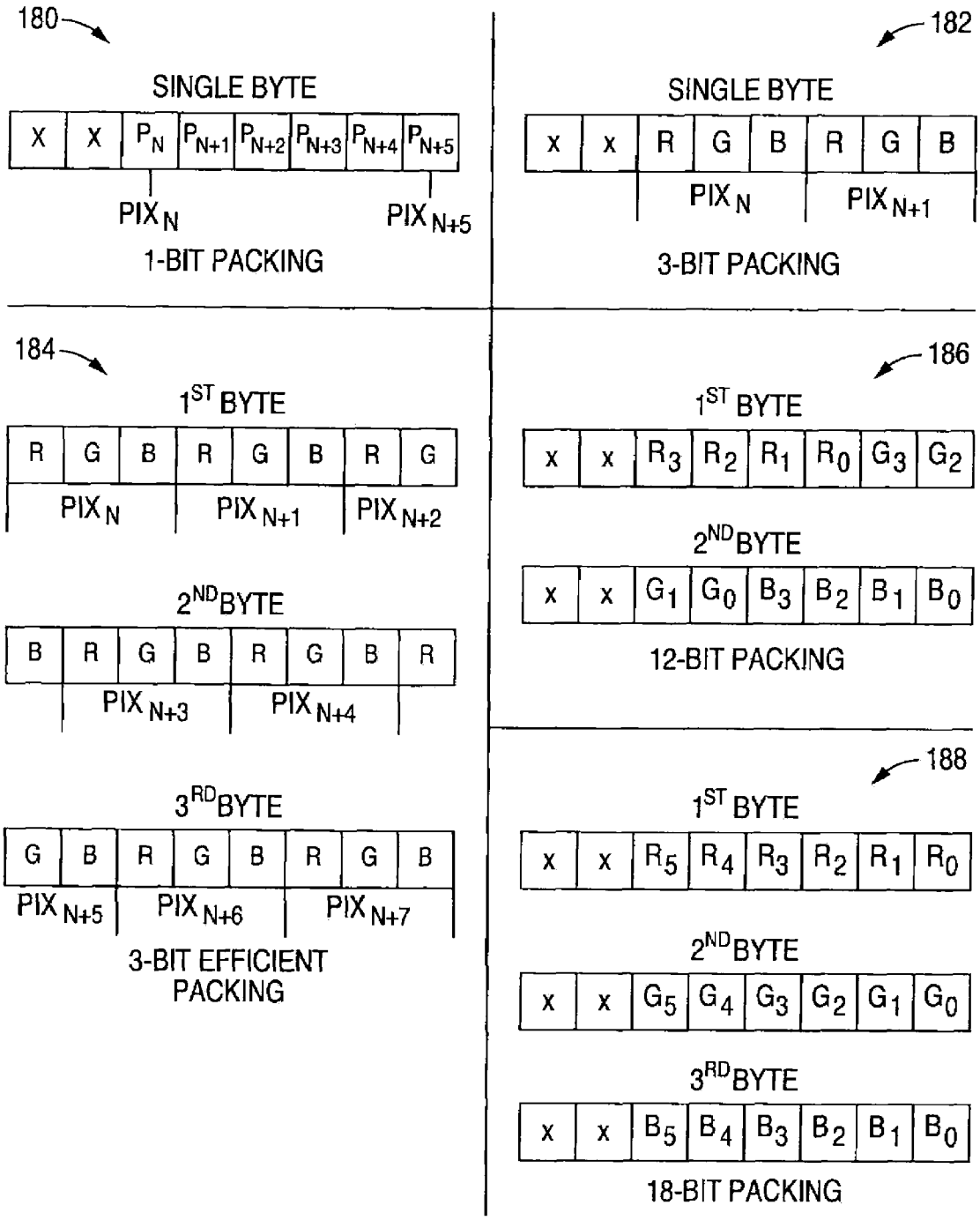

If the serial data into the LoSSI Interface 78 is to be written into the RAM 82, the data is transferred to the PM Data Packer where the serial data is parsed and sent to the RAM 82 depending on the format of the RAM data in the serial data in step 174 ("Parse the input data according to the format of the LoSSI data and store the parsed data in the RAM") in FIG. 3. FIG. 5 is a diagram of the five different configurations of the RAM data in each word of the serial data. In FIG. 5 the left hand bit is the first serial bit to arrive at the LoSSI Interface 78. The five configurations are a 1-bit per pixel configuration 180, a 3-bit per pixel standard configuration 182, a 3-bit per pixel efficient packing configuration 184, a 12-bit per pixel configuration 186, and an 18-bit per pixel configuration 188. When the RAM 82 is to be filled with 1-bit per pixel data shown in configuration 180, the first two bits are ignored, and the next six bits are data for six pixels. When the RAM 82 is to be loaded with 3-bits per pixel data, the pixel data can be sent to the display driver 36 in one of two configurations, the configuration 182 in which each serial data word holds data for two pixels, and the efficient packing configuration 184 in which three serial data words provide pixel data for eight pixels. Thus, the efficient packing configuration provides faster transfer of 3-bit per pixel data into the RAM 82 than configuration 182 by a factor of 8 to 6 in each of three serial data words. This faster transfer of data enables the partial memory image to be updated faster, which may allow the partial memory image to be perceived as more animated than if the configuration 182 were used to place 3-bit pixels into the RAM 82. The 12-bit per pixel configuration 186 uses two serial words to load the 12-bit pixels into the RAM 82, and the 18-bit per pixel configuration 188 uses three serial words to load the 18-bit pixels into the RAM 82.

Read Rate From the RAM 82

Figure 6A:
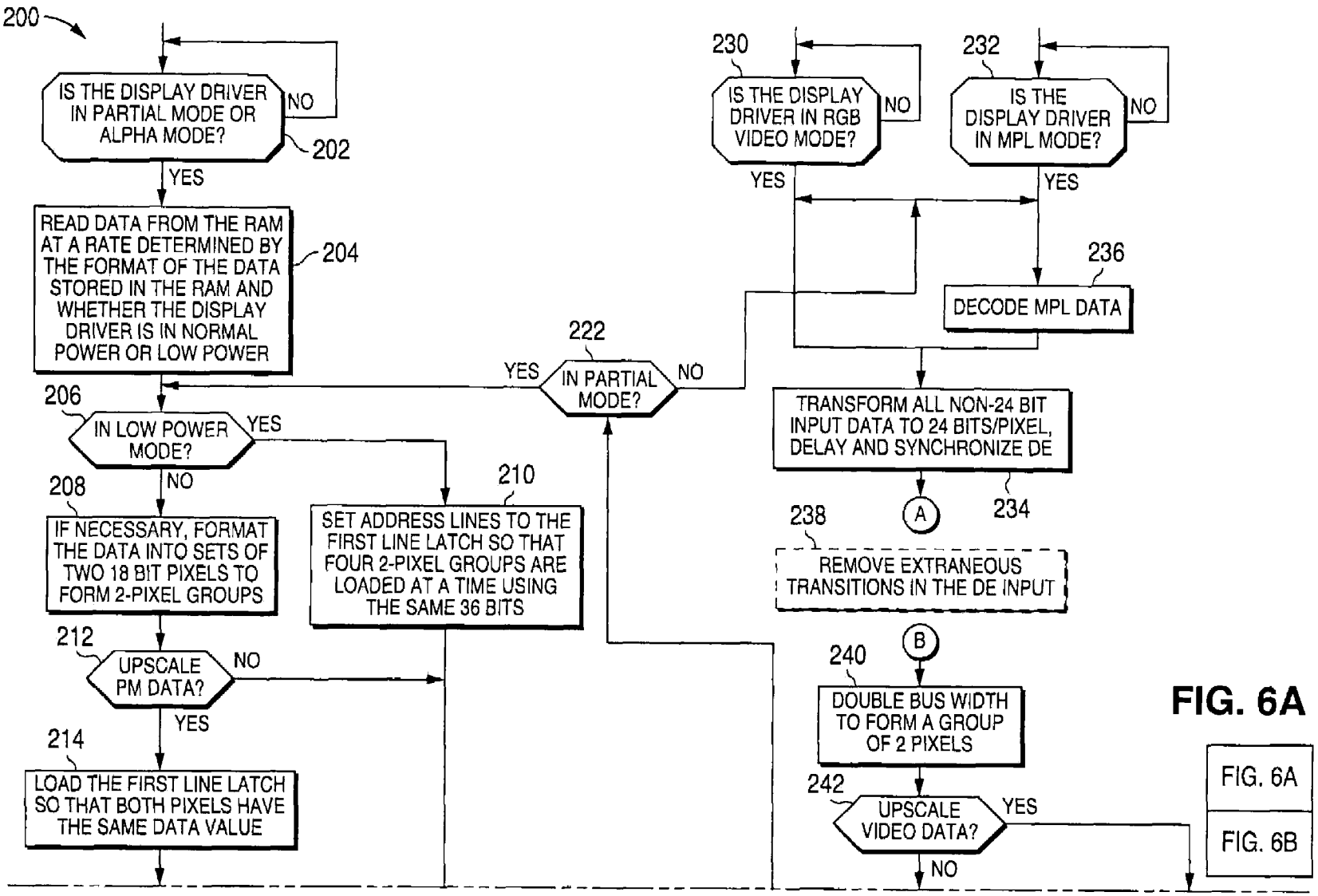
Figure 6B:
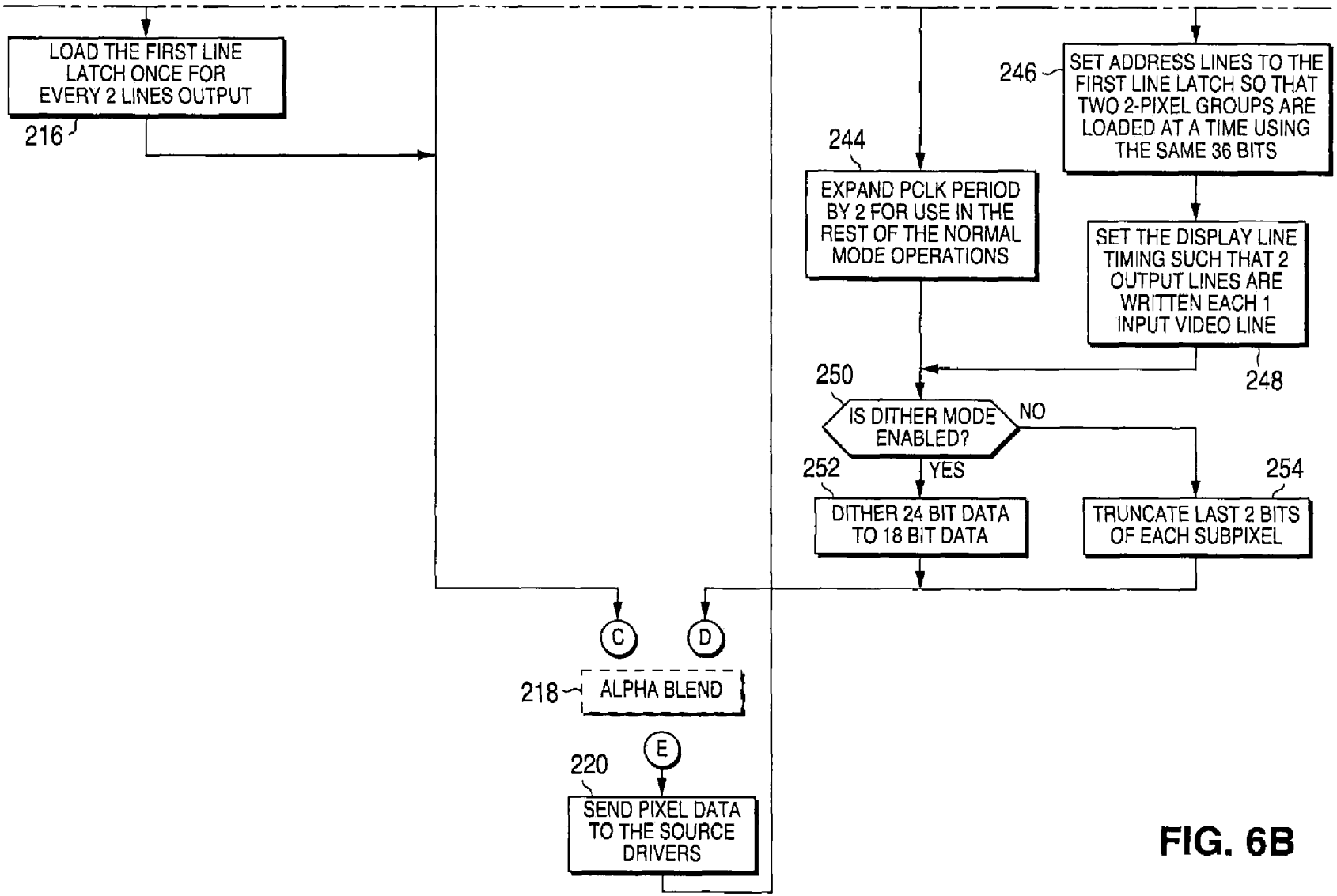
Figure 7A:
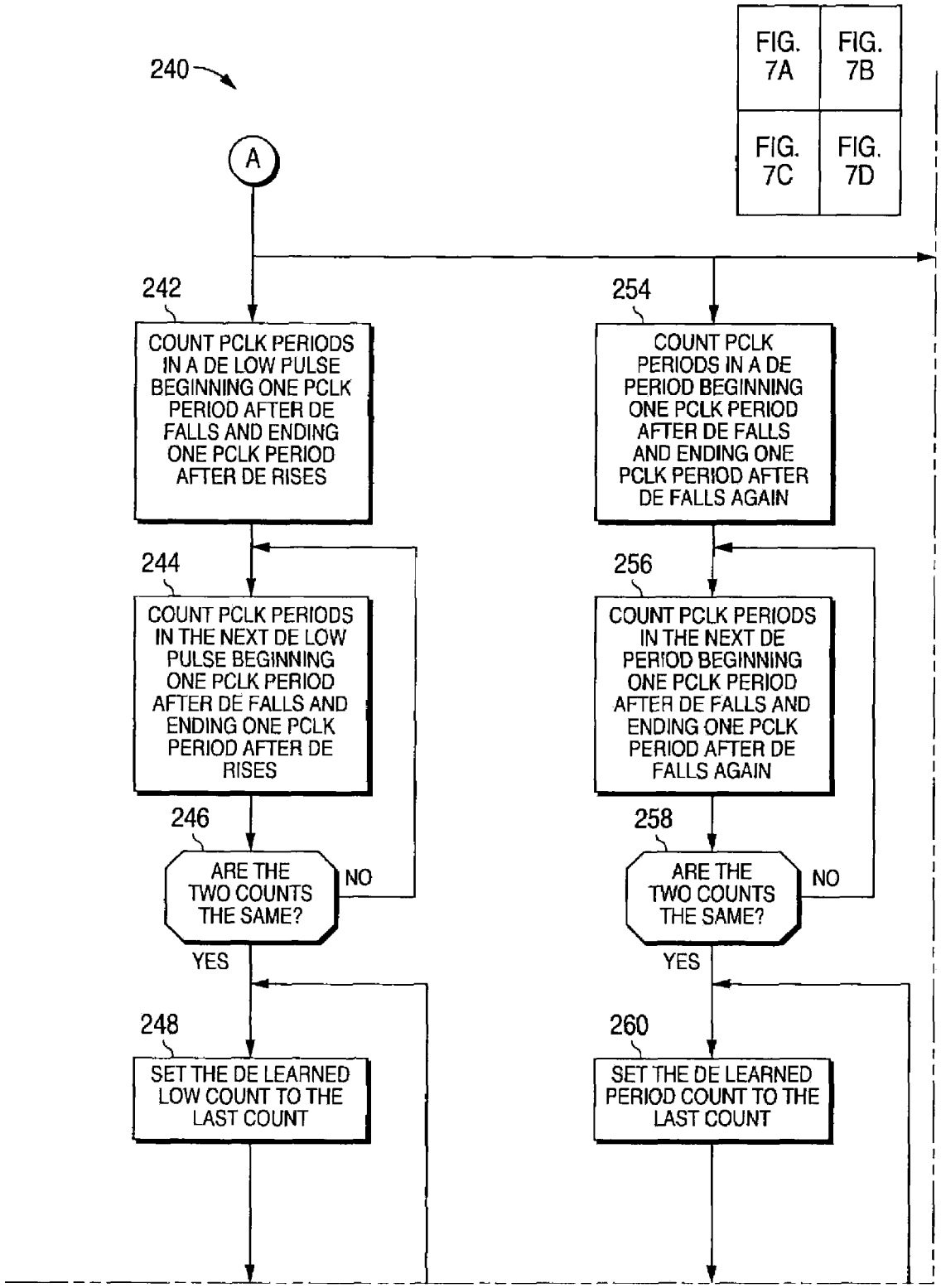
Figure 7B:
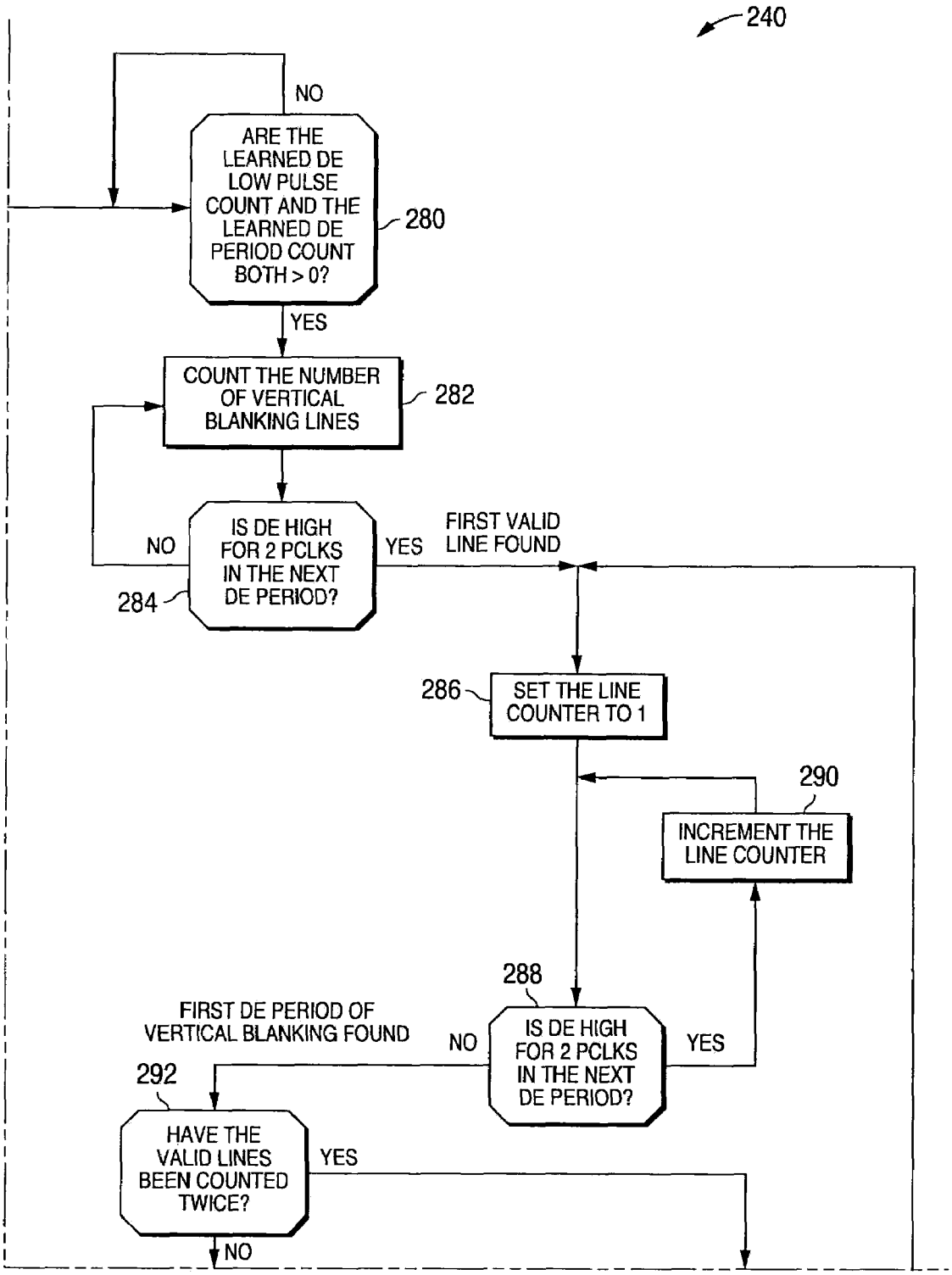
Figure 7C:
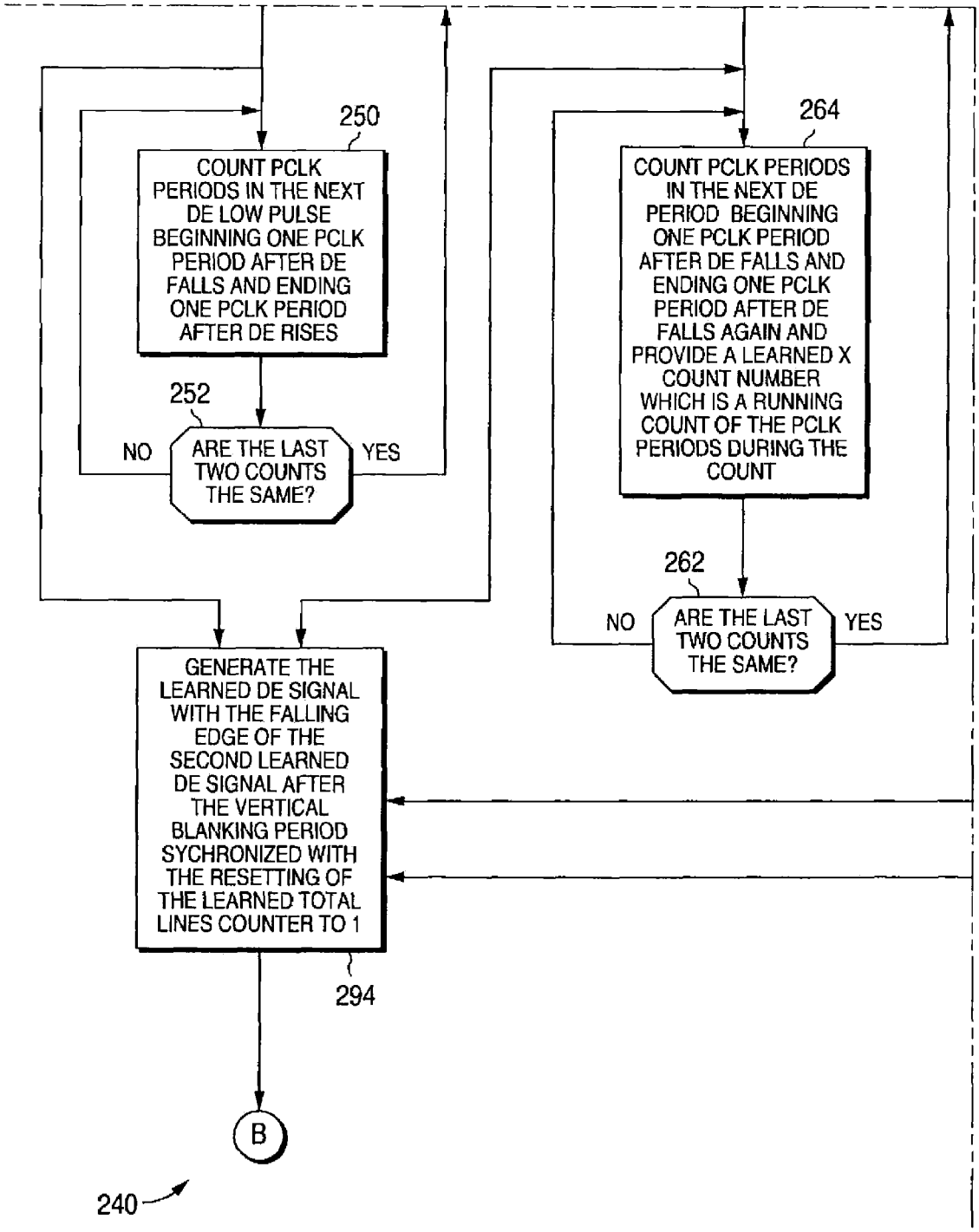
Figure 7D:
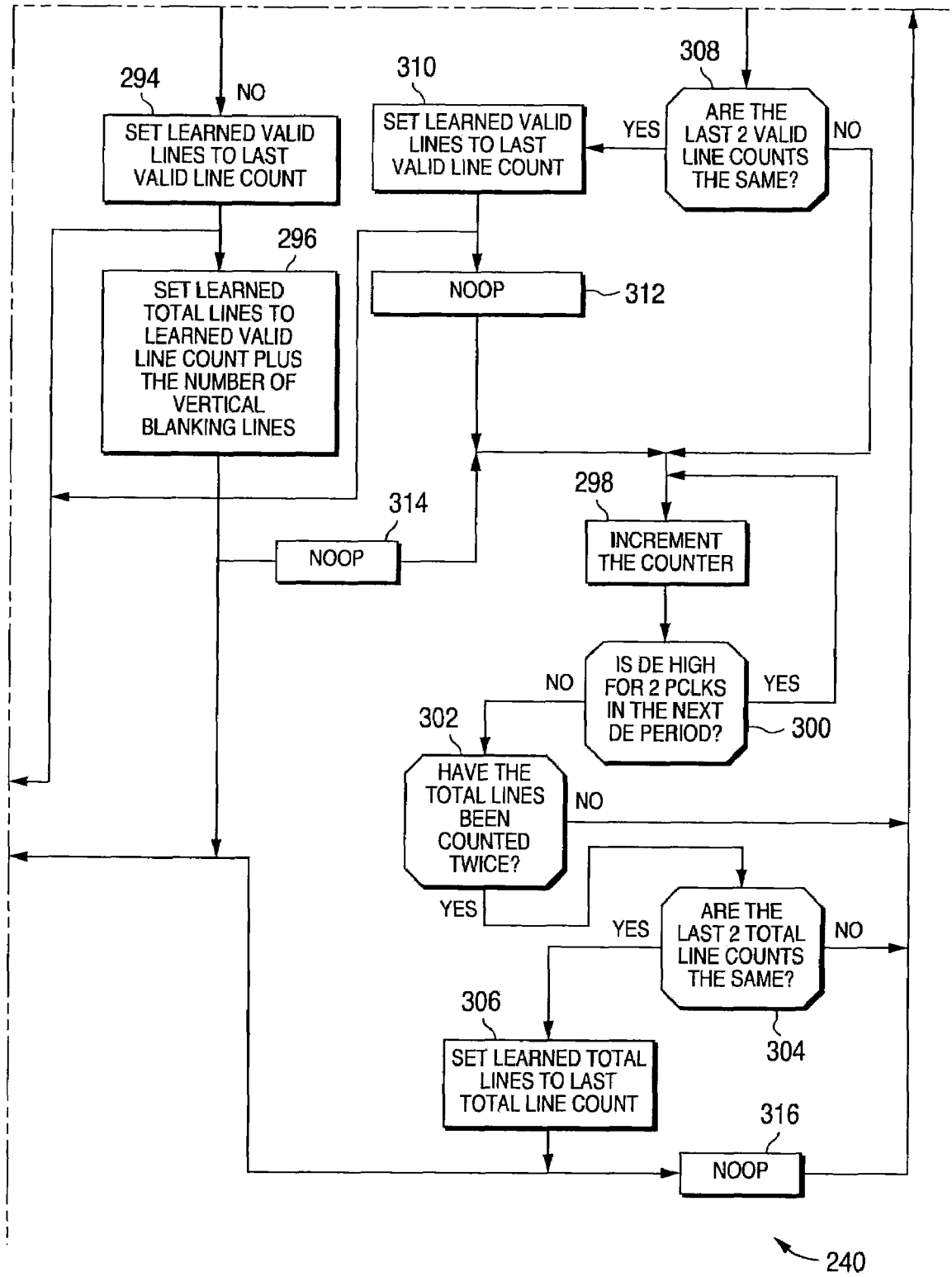

FIG. 6 is a flow diagram 200 of the transfer of partial memory data from the RAM 82 to the output channels 100 and the transfer of video or normal RGB data from the video input lines 40, 42, 54, and 56 to the output channels 100. The flow of pixel data from the RAM 82 to the output channels 100 is on the left side of FIG. 6 which begins by a determination if the display driver 36 is in either the partial mode, meaning that the image in the RAM 82 is to be displayed, or the alpha mode meaning that the image in the RAM 82 is to be combined with the normal video data as indicated in step 202 ("Is the display driver in partial mode or alpha mode?"). If the display driver 36 is in the partial mode or the alpha mode, the partial image data is read from the RAM 82 at a constant rate that depends on the partial mode configurations as indicated in step 204 ("Read data from the RAM at a rate determined by the format of the data stored in the RAM and whether the display driver is in normal power or low power"). The partial mode configurations include whether the display driver 36 is in alpha mode in which case the timing of the reading of data from the RAM 82 is set by the Pclk, or not in alpha mode in which case the timing of the display driver 36 is set by an internal oscillator which may have a frequency of approximately 13.0 MHz. Other partial mode configurations which affect the RAM read rate is whether the partial mode operation is at normal power or low power, and whether the image is to be upscaled for a 2× increase in the size of the image. These other partial mode configurations are described in more detail below.

Low Power Partial Mode

In the flow diagram of FIG. 6 a determination is made in step 206 ("In low power mode?") whether the partial mode is in the normal power mode or the partial mode. If in normal power mode, the RAM 82 data is formatted into 18-bit pixels by placing zeros in the least significant bit positions if necessary in step 208 ("If necessary, format the data into sets of two 18 bit pixels to form 2-pixel groups"). If in low power mode, which may be selected by the host processor 30 only if the data in the RAM 82 is 1-bit per pixel or 3-bits per pixel, each 18-bits of data sent to the output channels 100 will have data for 4 pixels allowing the partial mode oscillator clock (not shown) to be divided by 4 thus reducing the power consumed by the display driver 36 to be essentially one-fourth of the normal power. When the display driver 36 is in low power mode, two sets of 18-bit pixels are transferred to the output channels 100 at a time, data for 8 pixels is transferred to four latches of the output channels 100 at a time as indicated in step 210 ("Set address lines to the first line latch so that four 2-pixel groups are load at a time using the same 36 bits") where the term "First Row of Latchs" refers to the row of latches 110 shown and described in the Attachment B to this application.

Partial Upscale Mode

As shown in FIG. 6, if the partial mode is in normal power mode the partial memory RAM 82 data can be upscaled in step 212 ("Upscale PM data?"). Since in upscale mode each pixel is replicated in an adjacent column and in an adjacent line, the loading of data into the column latches is modified so that the sets of two-pixel data, or 36 pixel bits, consist of the data for one pixel replicated to fill both pixel positions as indicated in step 214 ("Load the first line latch so that both pixels have the same data value"). In addition, in order to provide two adjacent lines of the display with the same pixel data, the first line latch is loaded after every other line of the display is written in step 216 ("Load the first line latch once for every 2 lines output"). Whether the partial mode is in the low power mode or the upscale mode, the resulting partial data is passed to an alpha blend block 218 ("Alpha blend") which may or may not blend the normal power partial data with the normal video data and the resulting data is passed to source drives 100 as indicated in step 220 ("Send pixel data to the source drivers"). After the 2 pixel data has been written to the output channels 100, the display driver 36 begins the cycle again depending on whether the display driver 36 is in the partial mode or the normal mode as determined in step 222 ("In partial mode?") of FIG. 6.

Normal Video Mode

In the normal video mode the data is input to the display driver 36 as RGB 24 bit video or MPL video in steps 230 ("Is the display driver in RGB video mode?") and 232 ("Is the display driver in MPL mode?"), respectively. If the normal video data received is RGB 24 bit data, the data is sent directly to the video interface 90 where it is formatted into 24 bit pixels if necessary, the DE pulse is delayed, and the transitions in the DE pulse are synchronized with the Pclk in step 234 ("Transform all non-24 bit input data to 24 bits/pixel, delay and synchronize DE"). If the normal video data received is MPL data, it is decoded to parallel data in step 236 ("Decode MPL data"). After the normal video data is normalized by the processes in step 234, the normal video data is passed to DE Learning 92 and digitally filtered as indicated in step 238 ("Remove extraneous transitions in the DE input"). The operation of the DE Learning block is described in the DE Learning section below.

After the normal video data has passed through the DE Learning block 92, two normal video pixels are arranged as 36 bits of parallel data in the Video Mutiplexing block 94 in FIG. 2 in step 240 ("Double bus width to form a group of 2 pixels") in FIG. 6. The resulting video data is passed to the Upscale, Dithering and/or Truncation block 96 in which the determination is made if the video data is to be upscaled in step 242 ("Upscale video data?"). If the normal video is not to be upscaled, the Pclk frequency is divided by 2 for use in the rest of the normal mode processing in step 244 ("Expand PCLK period by 2 for use in the rest of the normal mode operations"). If the normal video data is to be upscaled, then each 24 bit pixel is replicated so that each of the two sets of pixels being processed in parallel are the same in step 246 ("Set address lines to the first line latch so that two 2-pixel groups are loaded at a time using the same 36 bits"). Then the line timing is adjusted such that two output lines are written for each one line of video in step 248 ("Set the display line timing such that 2 output lines are written each 1 input video line").

The determination is made as to whether the 24 bits per pixel are to be dithered to 18 bits per pixel or if the last two bits of each subpixel are to be truncated in step 250 ("Is dither mode enabled?"). Dithering of the 24 bit data, if applicable, is performed in step 252 ("Dither 24 bit data to 18 bit data"), otherwise the 24 bit data is truncated in step 254 ("Truncate last 2 bits of each subpixel"). The resulting 18-bits per pixel data is then passed to the alpha blend block 98 in FIG. 2 in step 218.

DE Learning

In the DE Learning block 92 the number of Pclk periods that the DE signal is low is counted during each DE pulse, and if two successive counts are the same, the count is labeled the Learned DE Low count. This count does not change until there are two subsequent successive DE low counts which are the same but different than the previous Learned DE Low count. The same principal is applied to the DE period, that is, the number of Pclk periods between successive falling edges of the DE signal are counted, and if two successive DE period counts are the same, the count becomes the Learned DE Period count. By generating the Learned DE Low count and the Learned DE Period count a one time variation in the DE low time or the DE period will not change the learned DE low count or the learned DE period count, respectively. The DE pulses are not present during the vertical blanking period of the display, and by detecting the absence of the DE pulses at the beginning of the vertical blanking period and the total time when the DE pulses are present and absent until they reappear, the number of valid lines and the number of total lines can be learned.

Figure 8:
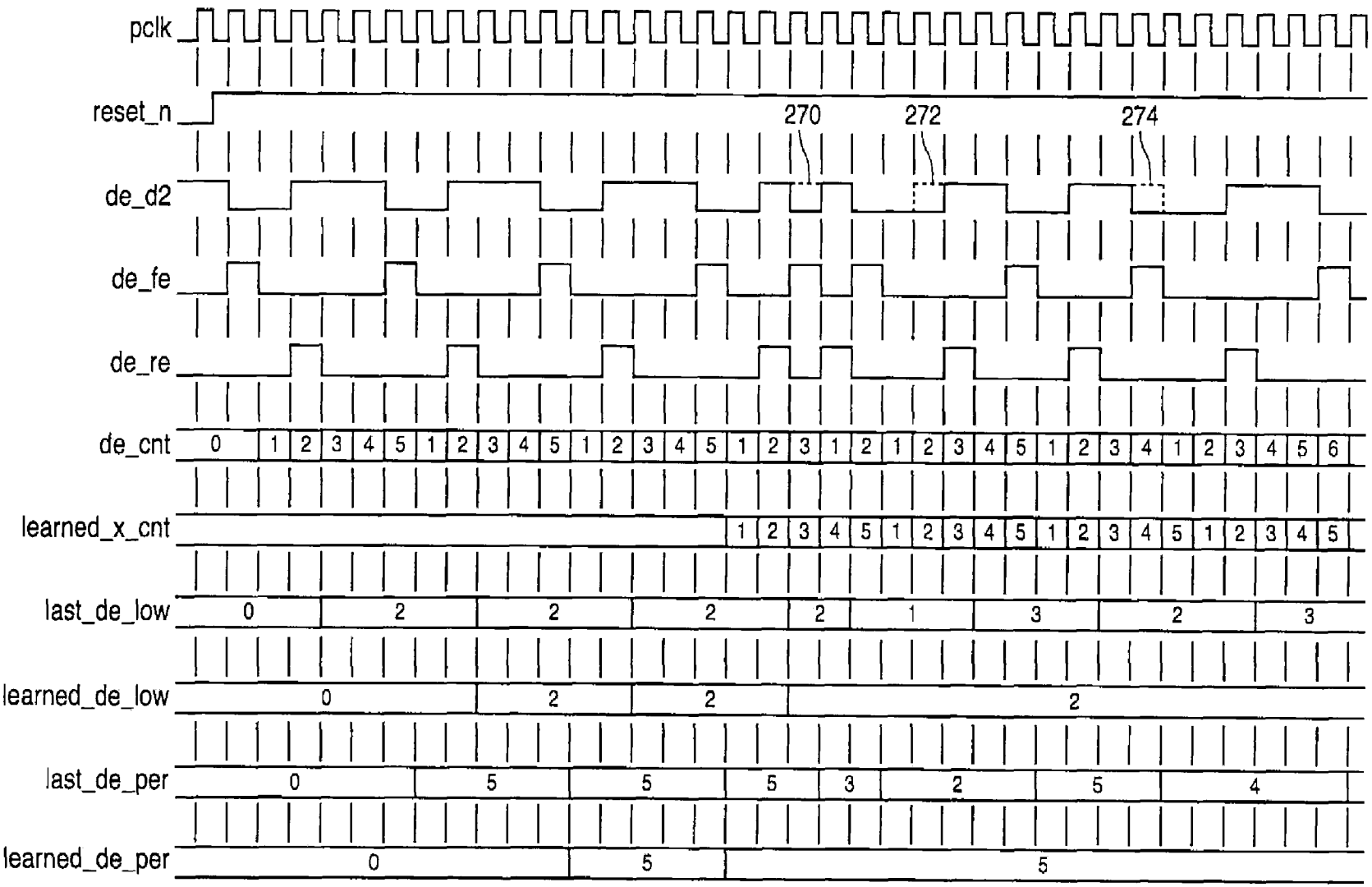

FIG. 7 is a flow chart 240 of the DE learning process between the circle A and circle B in FIG. 7 to provide a digitally filtered DE signal. As shown in FIG. 8 the Learned DE Low count and the Learned DE Period count begin when the first DE pulses are input to the DE Learning block 92 in FIG. 2, while the learning of the Learned Valid Lines and the Learned Total Lines only begins after the Learned DE Low count and the Learned DE Period count are nonzero. In FIG. 7 the number of Pclk periods during the low pulse of the DE signal is counted twice in steps 242 ("Count pclk periods in a DE low pulse beginning one pclk period after DE falls and ending one pclk period after DE rises") and 244 ("Count pclk periods in the next DE low pulse beginning one pclk period after DE falls and ending one pclk period after DE rises"), respectively, and the two counts are compared in step 246 ("Are the two counts the same?"). If the two counts are the same the Learned DE Low count is set to the last count in step 248 ("Set the DE learned low count to the last count"). If the two counts are different, then an additional count is made in step 244 and compared to the last count. This process continues until two successive counts are the same and the Learned DE Low count is set. After the count is set, during the next DE pulse the number of Pclk periods during the low state of the DE pulse is counted in step 250 ("Count pclk periods in the next DE low pulse beginning one pclk period after DE falls and ending one pclk period after DE rises"), and if the last two counts are the same, the last Learned DE Low count is set to the last count in step 252 ("Are the last two counts the same?"). If the two counts are not the same, the number of Pclk periods during the low state of the next DE signal is counted as indicated in block 250 and then compared to the last count in step 252. Thus the Learned DE Low count does not change unless there are two successive counts that are the same but different than the current Learned DE Low count. This process not only digitally filters the DE low pulse time, but also allows the display driver 36 to adjust to a new DE signal with a different low pulse time. Conversely, if there should be two glitches the same during two successive DE low pulse times, the Learned DE Low count will erroneously change, but will be corrected when two glitch free DE low pulses occur in a row. Since the display driver 36 in one embodiment refreshes the display sixty times a second, the one time glitch will result in virtually no perceptible change in the displayed image.

In the same manner as the Learned DE Low count is calculated, the Learned DE Period count is calculated. Thus the processes in steps 254 ("Count pclk periods in a DE period beginning one pclk period after DE falls and ending one pclk period after DE falls again"), 256 ("Count pclk periods in the next DE period beginning one pclk period after DE falls and ending once pclk period after DE falls again"), 258 ("Are the two counts the same?"), 260 ("Set the DE learned period count to the last count") and 262 ("Are the last two counts the same?") are the DE period counterparts of the processes in steps 242, 244, 246, 248, and 252, respectively. The process set forth in step 264 ("Count Pclk periods in the next DE period beginning one Pclk period after DE falls and ending one pclk period after DE falls again and provide a learned X count number which is a running count of the pclk periods during the count") performs the DE period counterpart of the process in step 250, but in addition generates a running count of the Pclk periods during the period count. This running count is used to determine when a DE pulse is missing indicating the start of the vertical blanking period.

FIG. 8 is a timing diagram of the relevant signals used to determine the Learned DE Low count, the Learned DE Period count, the Learned Valid Lines count, and the Learned Total Lines count. Shown at the top of FIG. 8 is the Pclk which in this embodiment is symmetric. Below the Pclk is a reset signal labeled reset_n from line 46 in FIG. 1A. Below the reset signal is the DE signal on bus 42 which has been delayed by two DE signal periods as indicated by the label de_d2. The relative lengths of the low pulses and the high pulses of the DE signal have been distorted in FIG. 8 to better illustrate the invention. Typically the width of the low pulse, which is the horizontal blanking period, is less than 5% of the width of the high pulse. The falling edge of de_d2 is used to generate a falling edge signal de_fe which begins on the falling edge of de_d2 and is one Pclk period wide. Similarly, the rising edge of de_d2 is used to generate a rising edge signal de_re which begins on the rising edge of de_d2 and is also one Pclk period wide. Below the de_re pulse signal is a counter labeled de_cnt which begins after the next falling edge of de_fe after the reset is deactivated by going high, and the count increments for each Pclk period until the next falling edge of de_fe, at which point it resets to a "1" count to begin the count again.

In a line labeled last_de_low is the number of Pclk periods counted from the falling edge of de_fe to the next falling edge of de_re beginning after the display driver 36 comes out of reset. As shown in FIG. 7 the first count of the last_de_low is 2, and the same is true for the next DE low pulse. As a result the learned_de_low changes from 0 to 2 after the second last_de_low count. Similarly, the last_de_per begins counting at the first falling edge of de_fe after the display driver 36 comes out of reset, and stops counting at the next falling edge of de_fe, at which point the last_de_per count starts again. After two consecutive counts which are the same, the learned_ de_per is set to the last count of the of the last_de_per. After the Learned DE Low count is other than 0, and the Learned DE Period count is other than 0, the learned_x_cnt counter begins counting at the next falling edge of de_fe and starts recounting on the next falling edge of de_fe after the learned_de_cnt reaches the same count as the Learned DE Period count.

Shown in FIG. 8 are three errors in the DE signal at reference numbers 270, 272, and 274. The dashed lines show what the correct DE signal should be. Each of these errors changes the de_cnt, the DE Low count, and the DE Period count as shown in FIG. 8. But because none of these errors produces two consecutive erroneous de_cnt with the same count, two consecutive erroneous DE Low counts with the same count, or two consecutive erroneous DE Period counts with the same count, the learned_x_cnt, the Learned DE Low count, and the Learned DE Period counts are unchanged, and these three errors are filtered out of the generated DE signal used by the rest of the display driver 36.

Figure 9:
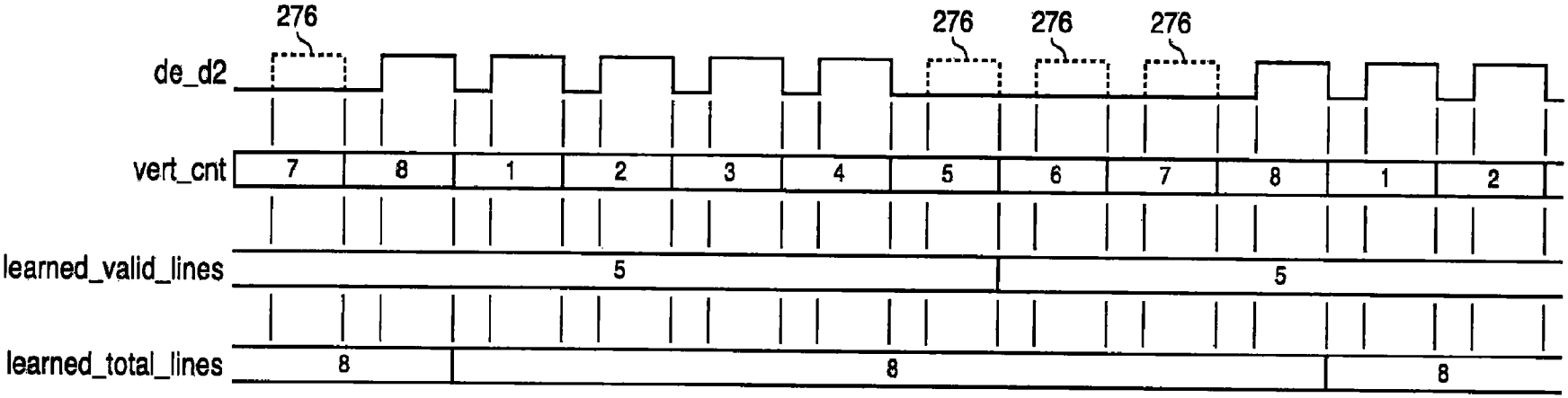

FIG. 9 is a timing diagram of a whole frame and is shown lasting for 8 DE periods to facilitate the illustration of the present invention. In practice, since each DE period corresponds to one row written into the display 34, the number of DE periods in each frame is much higher, usually in the hundreds. The DE pulses 276 shown as dashed lines indicate the vertical blanking period in each frame.

Returning to FIG. 7 and with reference to FIG. 9, a step 280 ("Are the learned DE low pulse count and the learned DE period count both>0?") shows that the process to determine the Learned Valid Lines and the Learned Total Lines does not begin until the Learned DE low count and the Learned DE Period count are both nonzero. The Learned DE Low count and the Learned DE Period count are set to zero when the display driver 36 is reset. After that condition is satisfied the number of vertical blanking lines are counted in steps 282 ("Count the number of vertical blanking lines") and 284 ("Is DE high for 2 pclks in the next DE period?") which also finds the first valid line. The line counter is set to 1 in step 286 ("Set the line counter to 1"), and a test is made in steps 288 ("Is DE high for 2 pclks in the next DE period?") and 290 ("Increment the line counter") to find the first DE period of the vertical blanking. Then step 292 ("Have the valid lines been counted twice") determines if the present line count is the first valid line count. If not, the Learned Valid Line count is set to the current line count in step 294 ("Set learned valid lines to vast valid line count"), and in step 296 ("Set learned total lines to learned valid line count plus the number vertical blanking lines") the Learned Total Line count is set to the current line count plus the number of vertical blanking lines determined in steps 282 and 284. Then the first line is found in steps 298 ("Increment the counter") and 300 ("Is DE high for 2 pclks in the next DE period?"). Step 302 ("Have the total lines been counted twice?") determines if the total lines have been counted twice, and if not, the operation moves to step 286. If the total lines have been counted twice, the two counts are compared to determine if they are the same in step 304 ("Are the last 2 total line counts the same?"), and if not the operation moves again to step 286. If the two counts are the same, the Learned Total Lines count is set to the last line count in step 306 ("Set learned total lines to last total line count") and the operation returns to step 286. If the test in step 292 determines that the valid lines have been counted twice, the two counts are compared to determine if they are the same in step 308 ("Are the last 2 valid line counts the same?"), and if not the operation moves again to step 298. If the two counts are the same, the Learned Valid Lines count is set to the last line count in step 310 ("Set learned valid liens to last valid line count") and the operation returns to step 286. The no operation (NOOP) steps 312, 314, and 316 are flow diagram tools used to correctly show the processing flow of the DE Learning procedure.

If the Learned DE Low count or the Learned DE Period count changes during the DE learning process, which operates continuously unless the display driver 36 is in a reset state or a sleep state, then the DE learning process is restarted.

Alpha Blending

Figure 10A:
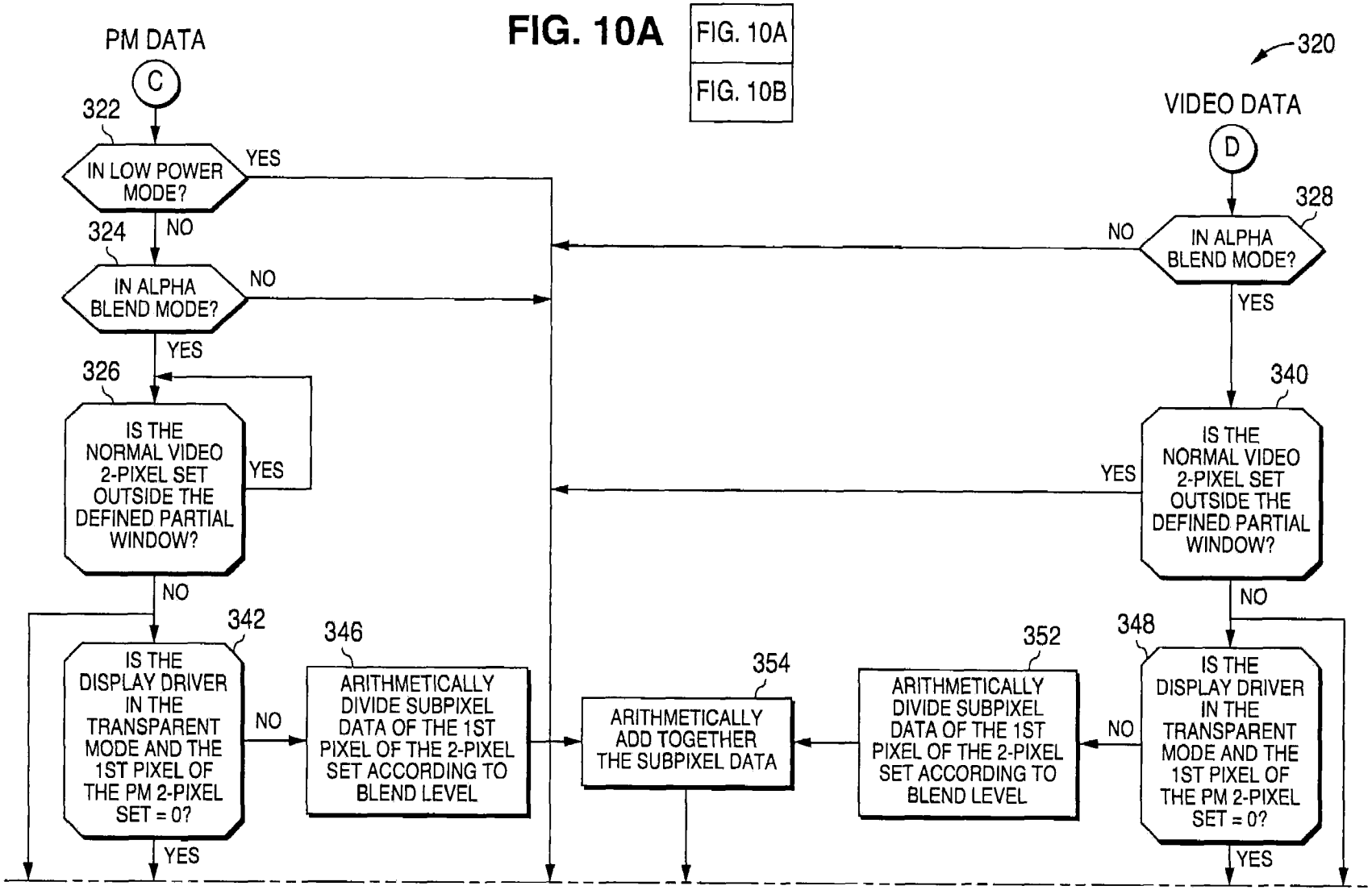
Figure 10B:
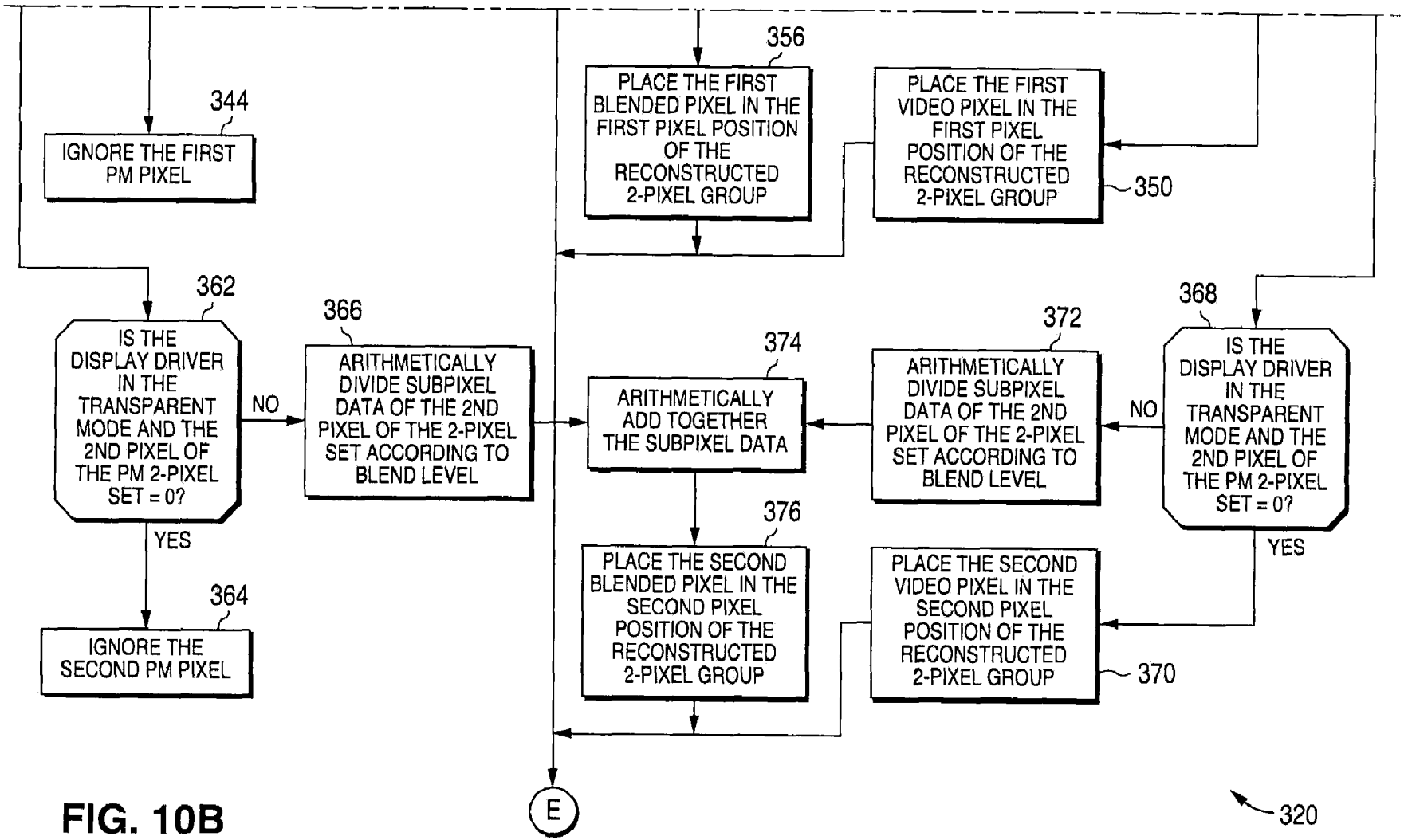

FIG. 10 is a process flow diagram 320 showing the operation of the alpha blend block 98 in FIG. 2. As shown in FIG. 10 partial mode data at circle C is passed to the output at circle E of the alpha blend block 98 if the display driver 36 is in the low power mode in step 322 ("In low power mode?") since the low power mode is not compatible with blending RAM 82 data and normal video data. Next a determination is made if the display driver 36 is in the alpha blend mode in step 324 ("In alpha blend mode?"), and if not, the partial mode data is passed to the output at circle E. Next a determination is made if the normal 2-pixel set is outside the defined partial window in step 326 ("Is the normal video 2-pixel set outside the defined partial window?"). If so, the partial mode data is held until a normal 2-pixel set that is inside the defined partial window is presently being processed, the defined partial window being defined by the partial memory starting and ending rows and the partial memory starting and ending columns which are set in registers that the host processor 30 can change to place the partial memory window at a desired location on the display 34. If the normal pixel data being displayed is at least partially in the defined partial window, each pixel of the two-pixel set is then processed separately and in parallel and later recombined before being passed to the output channels 100 through the output circle E of the Alpha Blend block 98.

Normal video data, if present, enters the alpha blend flow diagram 320 at circle D and the determination is made in step 328 ("In alpha blend mode?") if the display driver 36 is in alpha mode. If not the normal video data is passed directly to the output at circle E. If the display driver 36 is in the alpha blend mode a determination is made in step 340 ("Is the normal video 2-pixel set outside the defined partial window?") if the normal video 2-pixel set is outside the defined partial window. If so, the normal video 2-pixel set is passed to the output at circle E.

Each of the two pixels in the 2-pixel set is blended separately and at the same time and in the same manner. The partial memory pixel is examined in step 342 ("Is the display driver in the transparent mode and the 1st pixel of the PM 2-pixel set=0?") to determine if the display driver 36 is in the transparent mode, and if so, if the partial memory pixel data is all zeros (i.e., each of the three subpixel data is all zeros). If both conditions are satisfied, the partial memory pixel is ignored in step 344 ("Ignore the first PM pixel"). If one of these conditions is not satisfied the individual subpixels of the partial memory pixel are scaled down, if necessary, in step 346 ("Arithmetically divide subpixel data of the 1st pixel of the 2-pixel set according to blend level") to 75%, 50%, 25%, or 0% (set to all zeros) of their numerical value by methods well known in the art. In the normal video counterpart of this process, the partial memory pixel is also examined in step 348 ("Is the display diver in the transparent mode and the 1st pixel of the PM 2-pixel set=0?") to determine if the display driver 36 is in the transparent mode, and if so, if the partial memory pixel data is all zeros (i.e., each of the three subpixel data is all zeros). If both conditions are satisfied, the normal video first pixel is placed in the first pixel position of the modified 2-pixel set to be formed in step 350 ("Place the first video pixel in the first pixel position of the reconstructed 2-pixel group"). If one of these conditions is not satisfied the individual subpixels of the normal video pixel are scaled down, if necessary, in step 352 ("Arithmetically divide subpixel data of the 1st pixel of the 2-pixel set according to blend level") to 0%, 25%, 50%, or 75% of their numerical value and the scaled partial memory subpixels and the scaled normal video subpixels are added together in step 354 ("Arithmetically add together the subpixel data"). The blended pixel is placed in the first pixel position of the modified 2-pixel set to be formed in step 356 ("Place the first blended pixel in the first pixel position of the reconstructed 2-pixel group").

The second pixel of the incoming 2-pixel set of the partial memory data and the normal video data is processed in the same manner as the first pixel of the 2-pixel set in steps 362 ("Is the display driver in the transparent mode and the 2nd pixel of the PM 2-pixel set=0?"), 364 ("Ignore the second PM pixel"), 366 ("Arithmetically divide subpixel data of the 1st pixel of the 2-pixel set according to blend level"), 368 ("Is the display driver in the transparent mode and the 2nd pixel of the PM 2-pizel set=0?"), 370 ("Place the second video pixel in the second pixel position of the reconstructed 2-pixel group"), 372 ("Arithmetically divide subpixel data of the 1st pixel of the 2-pixel set according to blend level"), 374 ("Arithmetically add together the subpixel data"), and 376 ("Place the second blended pixel in the second pixel position of the reconstructed 2-pixel group") which correspond with steps 342, 344, 346, 348, 350, 352, 354, and 356, respectively.

Controlling the Position of the Image on the Display

Figure 11:
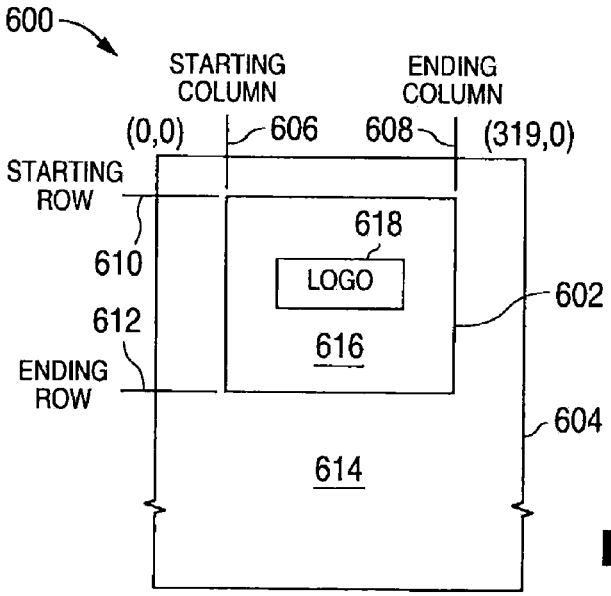

Turning to FIG. 11, there is shown a display 600 carrying a Display Image (DI) 602 in window 604 which may be a normal video image or an image generated when the display driver 36 is in partial mode. The DI 602 is defined by a set of coordinates on the display. Those coordinates are the starting column 606, the ending column 608, the starting row 610 and the ending row 612. The balance of the display 600 surrounding the DI 602 is the border 614. DI 602, for example, may include a background color region 616 that surrounds a trademark or logo region 618 associated with the device itself, or with the service provided by the device. The image 602 is displayed automatically when the device enters its partial mode of operation. The device may enter low power after a preset time without any user input. Transition to the low power mode and the reduced display may also be limited to battery charge status.

The RAM 82 described above is used to store image data for local refresh of the display. It may be used as the sole video source in partial mode or its contents can be blended with (or overlaid on) the incoming video data in alpha blend mode. While operating in partial mode, system power is greatly reduced because the video controller in the system may be shut down. In this mode, image data is read from the RAM 82 and used to refresh the display. All display refresh timing is derived from the internal oscillator (not shown) so that no external video signals are required.

In the preferred embodiment, the RAM 82 contains 230,400 bits of memory. This size is sufficient to display an 80×320 window of 3-bit data, or any equivalent size in terms of the totals pixels contained in the display window (DW) multiplied by the color depth of each pixel.

Figure 12:
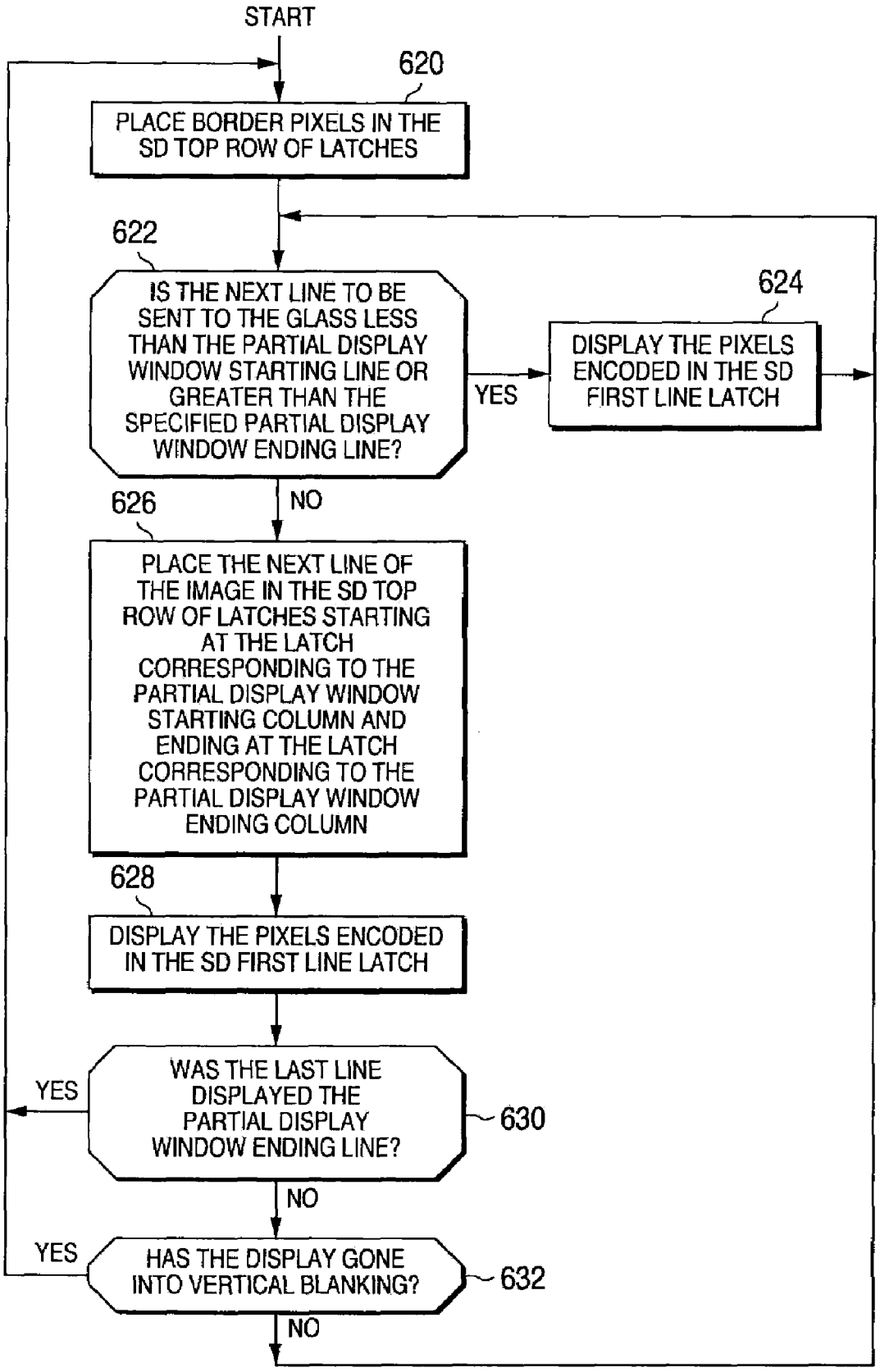

The system processor senses when the device enters a power down mode, termination of the video mode and/or when the time for displaying video mode expires. Instructions stored in a memory may then operate the display to load the display with data from the RAM 82. The steps for carrying out this operation are shown on FIG. 12.

As a first step 620 ("Place border pixels in the SD top row of latches"), the display driver 36 reads the border data into the display. Border data may be stored in all of the first row of latches identified with reference numeral 110 in the Attachment B to this application inasmuch as it is the same for all border pixels.

In the next step 622 ("Is the next line to be sent to the glass less than the partial display window starting line or greater than the specified partial display window ending line?"), the display driver 36 reads the RAM 82 and the data in the registers 72 for the DI 602. As explained elsewhere in this patent, the output of the RAM 82 is supplied to the output channels 100 via a pair of buses. The addresses of the data are examined and if the pixel is outside the coordinates of the DI, the pixel is a border pixel and remains unchanged, the answer is "yes" and the pixel in the latch remains the same and the pixels in the latch are sent to the display 34 in step 624 ("Display the pixels encoded in the SD first line latch"). However, if the pixel is in the DW, the display driver 36 proceeds to the next step, 626 ("Place the next line of the image in the SD top row of the latches starting at the latch corresponding to the partial display window starting column and ending at the latch corresponding to the partial display window ending column").

In that step, the non-border pixels are loaded into the top latch, multiple columns at a time, to form a row of the DW. As explained elsewhere, the display driver 36 provides efficient data packing so that multiple columns are filled at the same time. The output channels 100 receive 36 bits of data at a time, and due to data packing, as many as eight columns may be filled in one clock cycle. Thereafter, the source driver loads the output channels as described above until an entire line of pixels is in the first row of latches identified with reference numeral 110 in the Attachment B to this application. Upon completion of loading, the pixels are displayed as provided in step 628 ("Display the pixels encoded in the SD firs line latch").

If the last line displayed was the DW ending row 612, the display driver 36 repeats the steps described above. See step 630 ("Was the last line displayed the partial display window ending line?"). If not, the processor checks to see if the display has gone into vertical blanking (step 632: "Has the display gone into vertical blanking?"). If so, the processor jumps to step 622 and repeats the subsequent steps.

The host processor 30 is thus able to position the image on the display 34 by loading the appropriate registers 78 with the display window starting line, the display window ending line, the display window starting column, and the display window ending column. By this method the image can be moved up or down with two register writes to load new starting and ending line numbers, can be moved right or left with two register writes to load new starting and ending line numbers, or can be moved to a new vertical and horizontal position with four register writes to the display driver 36. Thus the image can easily be positioned to operate as a screen saver.

Gamma Compensation

Figure 13:
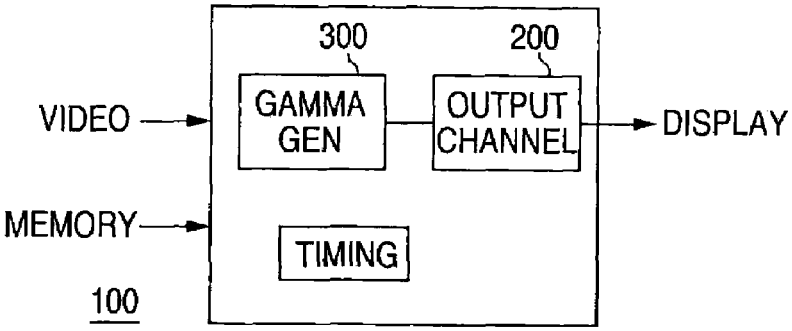

Turning to FIG. 13, a Source Driver Circuit (SDC) 100 provides digital image data to output channels 200 coupled to the sources of the pass transistors. Gamma generator circuit (GGC) block 300 converts input digital image data to analog voltages required to drive the source lines on the glass. The digital image data may come from a streaming video interface or another source such as a register, a full frame memory, or a partial display memory. The SDC has a predetermined number of output channels 200. In the preferred embodiments, there are 320 output channels. Each output channel receives RGB data for one pixel and performs a digital-to-analog conversion of the red, green, and blue data in a time-multiplexed sequence that is synchronized to the glass demultiplexor select signals (CKH1-3). The conversion sequence of the RGB data within each line time is determined by the settings for a first register.

A register bit in the first register controls the data loading direction of the output channels. For display applications in which the pixels/line of the glass is less than 320 channels, a second register can be used to specify which outputs are active and which outputs are unused by the application. This can help optimize the source line fan-out region between the driver and the glass active region. The second register is specified in conjunction with the first register setting. If the load direction is set for the S0→S319 direction, the second register is referenced to the S0 output. If the load direction is set for the S319→S0 direction, then the second register is referenced with respect to the S319 output.

The voltage transfer characteristic of the channel driver DAC is determined by the 64 gamma reference voltages generated by the Gamma Reference Circuit (GGC). The drive strength for the channel driver output is also programmable to optimize settling and power performance for panels of various sizes and parasitic capacitive loads.

There are four different intrinsic gamma curves available in the preferred embodiment of the gamma generation block 300. It generates 64 reference voltages for each gamma curve. The intrinsic curves may accomplish various goals for the module user. One goal might be to obtain matching optical performance from various module suppliers. It is even possible to optimize the individual curve shapes for the different color channels of a given supplier. In these cases, the four curve options can be optimized for each of the module supplier's glass characteristics and the selection of the proper curve and settings is possible.

Another reason for using multiple intrinsic curve settings might be to provide multiple gamma characteristics (e.g. $\gamma$=1.0, 1.8, 2.2, 2.5) for a given module in order to optimize performance for various viewing conditions and applications. In this case, the various curves can be selected via a Gamma Set command or through direct register access to the Gamma Register settings.

After selecting the intrinsic curve that most closely matches the desired characteristic, the curve shape can then be further optimized as explained later in this patent. Four shapes are used in the preferred embodiment, but those skilled in the art understand that the invention may be practiced with one or any number of gamma selection curve shapes. The user may select one shape for all colors or choose separate curves or adjustment settings for each color channel. This same intrinsic shape may be used for the green and blue curves with different optimization settings, or different intrinsic shapes and optimization settings may be chosen for each color channel. For a given color channel, the same intrinsic curve shape may be used for both drive polarities. Other customized gamma curves may be generated from the disclosed gamma-generating block, for example, by adding output multiplexors with more than 4-to-1 selections.

Source Driver Circuit: Output Channel Block

The Source Driver Circuit (SDC) 100 has two major circuit blocks. One is the output channel block 200 that carries the digital image data for each pixel. Each column is a channel. The other is the gamma generator circuit block 300.

Figure 14:
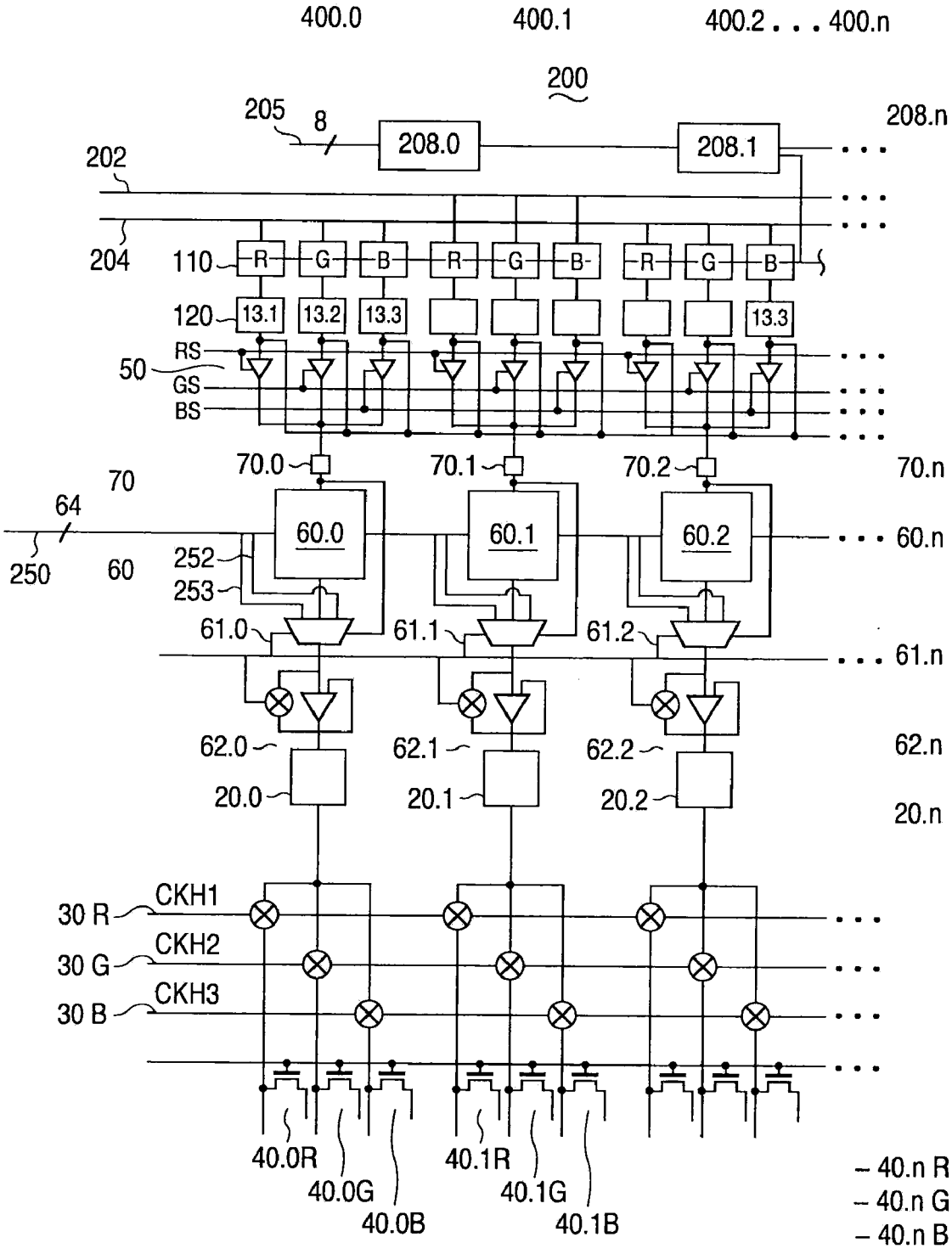
Figure 17:
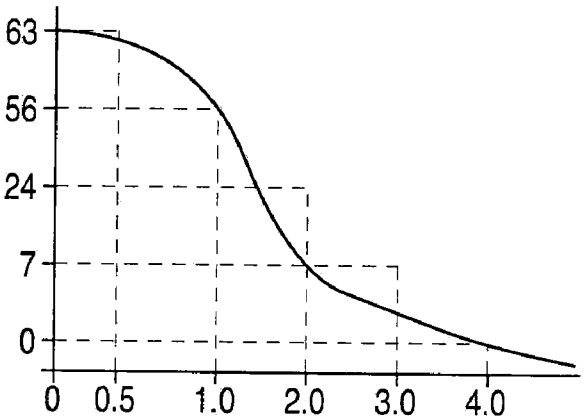

The SDC 100 operates in two modes: a normal mode where video data streams into the LCD and a low power mode (three-bit or one-bit) where data from the partial RAM or other memory drives the display. Turning to FIG. 14, the SDC 100, in the normal mode, loads each channel 400.*n* in a row, two channels (columns) at a time. Data is carried over even and odd busses 202, 204. A eight-bit address bus 205 runs to address decoders 208.*n*. There is one decoder 208 for each pair of even and odd channels. After the first latch row 110 is fully loaded, its data are transferred to a second latch row 120. Each channel (column) 400.*n* has a decoder 60 that converts an input digital data signal to an output analog voltage for driving a sub-pixel. The analog voltage is applied to a column pad 20*n*. The glass demultiplexors 30 RGB and pass transistors 40 at the intersections of rows and columns switch the analog voltage on the pads 20*n* to the liquid crystal sub-pixel in the display.

In normal mode, video data streams to the SDC 100 from the system processor. The image data is loaded into the output channels 400 and each data value is converted into analog voltages supplied from the gamma generation block 300 to drive the color pixels in a liquid crystal display. Normal mode uses eighteen (18) bits of data for each pixel. Each pixel has three sub-pixels, one for red, a second for blue and third for green. Each sub-pixel is a 6-bit word. Thus, there are 18 bits of data for each pixel including three 6-bit words, one for each sub-pixel. The output channels 200 convert the digital data value for each sub-pixel into an analog voltage for driving the sub-pixel. Conversion is done one color at a time and each color conversion may be made with a separate gamma for each color. The driving analog voltage is applied to the liquid crystal at the sub-pixel location in the display. The magnitude of the applied driving analog voltage controls the transmissivity of the liquid crystal in a manner well known to those skilled in the art.

Source Driver Circuit: First and Second Latches

As shown in FIG. 14, the SDC 100 outputs 36 bits of data at a time to the output channels 200. The data are fed over two busses 202, 204. In the normal mode, each bus carries 18 bits of data for one pixel and together the busses 202, 204 carry the data for two adjacent (even and odd) columns. The pixel address block 208 directs the data from one bus to the even latches in row 110 and the data for the other column to the odd latches in row 110. There is a latch for each pixel. Within each latch are three six-bit registers that hold 18 bits of RGB data for each pixel. After the first row 110 is fully loaded, its enable signal 101 goes high and its contents transfer to the second row 120. As a result, the columns 400 in row 110 can be loaded with data for future pixels. Upon completion of the loading, the data for an entire row of pixels is loaded into the second latch 120.

The SDC 100 always loads data into the latch 110 whether the device operates in normal mode, three-bit mode or one-bit mode. During three-bit mode, there are eight possible states for each sub-pixel: white, black, red, blue, green, and combinations of the colors to produce yellow, cyan and magenta. In one-bit mode, the sub-pixels are all the same and each pixel is only white or black.

To save power in 3-bit mode the, the internal oscillator (not shown) will be divided by 4. This divided oscillator will clock all the digital blocks. One or more unnecessary circuit blocks (e.g. backlight, not shown) are gated off to save power. Eight 3-bit pixels will be output at a time, and the address and address (bar) outputs will have the two least significant bits (lsbs) set to one, addressing eight, three-bit pixels at a time. The pix0 and pix1 outputs will pack the eight, three-bit pixels as shown in FIG. 4.

Pixel blocks always have 18 bits of data. For three-bit mode, the data of pixels blocks pix0 and pix1 are loaded into the even/odd (left/right) columns as shown. The loading is redundant and repeated four times. However, after four loads, each latch will have at lest four bits for each sub-pixel. The two least significant bits in each sub-pixel latch of the data bus are not used. In the one-bit mode, the data for all three bits of one color are the same.

Source Driver Circuit: Decoders

Data for the row 120 is converted from digital to analog, one color at a time, in order to drive the source lines of the thin film transistors on the display. The outputs of the row 120 are multiplexed to the column decoders 60 by tri-sate buffers 50. At any one time a single color, six-bit word representative of red, or blue or green, is enabled and passed to the decoder 60. In other words, the data in registers 13.1, 13.2 and 13.3 in each latch are sequentially converted from digital to analog voltages. Conversion is done simultaneously on each register 131 (red) in each latch and repeated to convert first red, then blue and finally green.

The decoders 60 convert digital signals to analog voltages. Each one is a 64-to-1 analog multiplexor. For a digital input from a register 13.1, 13.2 or 13.3, the decoders 60 select one of sixty-four input analog voltages. Those voltages drive the color pixel. Each decoder 60 is coupled to the a 64-line output bus 250 of the Gamma Generator Circuit (GGC) 300. As will become clear below, each color in the GGC 300 has its own gamma. Digital-to-analog conversion is performed serially, one color at a time. For example, upon setting red select, the six-bit red word from register 131 is input to the decoder 60. The decoder 60 receives sixty-four red reference voltage signals from which it selects the voltage level that corresponds to the six-bit red word. The decoder 60 is a 64-to-1 analog multiplexor in the form of a tree decoder. Such decoders are well known in the art. For any given six bit digital word, there is only one valid path through the decoder tree. The input end of each potential valid path is connected to one of the 64 reference voltages and the digital signals from the register 13.1, 13.2 or 13.3 set the valid path to connect the analog voltage that corresponds to the digital signal.

There are level shifters 70 between the outputs of the tri-state buffers 50 and the decoders 60. The level shifters is run in a digital domain to save power. The digital voltage is about 1.8 volts and the analog voltage is up to 5.5 volts. This feature helps conserve power because power is proportional to voltage squared. As such, as large a portion of the invention as possible operates in the digital domain as possible.

The analog output of the decoder 60 is connected to a 3-to-1 analog multiplexor 61. It has three analog inputs including a first analog input representative of six-bit data input for normal mode, and second and third analog inputs representative of one-bit data inputs for one-bit and three-bit mode. It has two control signals. One selects normal mode for decoding the first analog signal and the other selects the second or third analog signal. During normal mode, the multiplexor 61 receives the color (first) analog voltage and passes it to the pad 20 of the display. However, during three-bit mode, multiplexor 61 takes the zero or one data from the second and third analog inputs and applies them to the pad 20.

The output of the multiplexor 61 is connected to amplifier 62 that buffers the analog voltage during 18-bit mode from the pad 20. During normal mode, multiplexor 61 passes the decoded analog voltage output to the operational amplifier 62. It buffers the color voltage signal and applies it to the pad 20 of the column. However, during 3-bit operation, the operational amplifier 62 is powered down and a parallel switch in the op amp 62 shunts the input to the output. As such, the output of the multiplexor 61 during three-bit mode is connected to the pad 20. The multiplexor 61 receives a reference voltage directly from the GGC 300 and applies the reference voltage directly to the pad 20 via the bypass connection of the operational amplifier 62.

The LCD glass display has three thin film pass transistors, 40R, 40G, or 40B, (one for each color) for each pixel. The channel driver has separate select signals Rs, Gs, and Bs for selecting the data for the red, green, or blue sub-pixel to be displayed. The glass panel has three clock lines, CKH1 (red), CKH2 (green), and CKH3 (blue) that control, respectively, the operation of the red, green, and blue sub-pixels. In one embodiment, the select signals Rs, Gs, and Bs and the clock signals CKH1-3 may be the same or may be switched to be the same. In all cases, when CKH1 goes high, the red voltages for each of the columns are clocked into the red sub-pixels for the selected row. The color selection and clocking is repeated for blue, green until the entire row has its color voltages. A timing controller (not shown) controls the clocking of the color select signals and the clock lines CKH1-3. The timing controller may be a separate block from the SDC or may be an integral block within the SDC. Such configurations of timing controllers and channel driver circuits are known to those skilled in the art. The timing controller (not shown) moves from row to row until the display is filled.

The thin film transistor 40R turns on when red is selected. The output analog voltage on the pad 20 is applied to the red sub-pixel in the first column of the display. All the red sub-pixels are enabled simultaneously. The process is repeated for the other two colors until the row is entirely energized. The display is capacitive and that feature allows the sub-pixels to be rapidly set to their color level determined by the six-bit color word. The capacitive feature holds the voltage on the sub-pixels until the display is refreshed. As such, each sub-pixel is energized rapidly to provide a mix of three colors and the rows in the display are rapidly loaded to display a frame of an image. The sequencing of the illumination of the red, green, and blue sub-pixels occurs in too short a time to be notice by the human eye and the capacitance of the display is sufficient to maintain the appearance of continuous color.

Among the advantages of the invention is the common use of the decoders 60, multiplexors 61, and operational amplifiers 62 by each color pixel. Instead of separate decoders and amplifiers for each color (3×320=960), the preferred embodiment has only one decoder and one operational amplifier for all three colors.

Those skilled in the art understand that row select signals (not shown) are used to select the rows during each write to the display. The row select signals begin on the top or the bottom row and works row-by-row until the entire display is written. Then the process begins again for the next frame of video. The number of rows is arbitrary. In the preferred embodiment, there are 480 rows. However, those skilled in the art understand that a display may have more or fewer rows and the SDC is configured to drive all the rows in the selected display.

Source Driver Circuit: Gamma Generator Circuit (GGC)

The GGC block 300 is shown in FIG. 15. It is a network of eighty range resistors 390, five range decoders 370, five range amplifiers 350, a reference resistor string 330 with sixty-four reference voltage outputs 310.00-310.63 and sixty-four, 4-to-1 analog multiplexors 320. For heuristic purposes, FIG. 15 shows only five output multiplexors. The outputs of the 64 multiplexors 320 are placed on the 64 bit output bus 250 to provide a selection of 64 reference voltages to the DACs 60 of the output channels. The GGC is capable of generating separate gamma values for each color, both for positive and negative voltages. The GGC overcomes the problem of look up tables and instead is a real time analog voltage generator for the LCD display. The GGC is also capable of switching on the fly from one gamma curve to another to enable the display to have different gammas for each color. The GGC is adjustable to be compatible with gammas for different displays. Each gamma value may be altered to accommodate different displays.

Those skilled in the art understand that the polarity applied to the liquid crystals should be reversed periodically. If a single polarity voltage is continuously applied to a liquid crystal the crystal may become permanently oriented or lose its ability to change. As a result a ghost image will be imposed on the display. In order to avoid this problem the voltages 301, 302 on the gamma reference network are periodically reversed to provide opposite polarity voltages to the lines/rows of the display. A typical technique is line inversion where each line has a first polarity voltage applied in one frame and an opposite polarity voltage applied in the next frame. Another technique is pixel inversion where adjacent pixels a first frame have opposite polarities and the polarities on the pixels are reversed on the next frame.

Figure 15A:
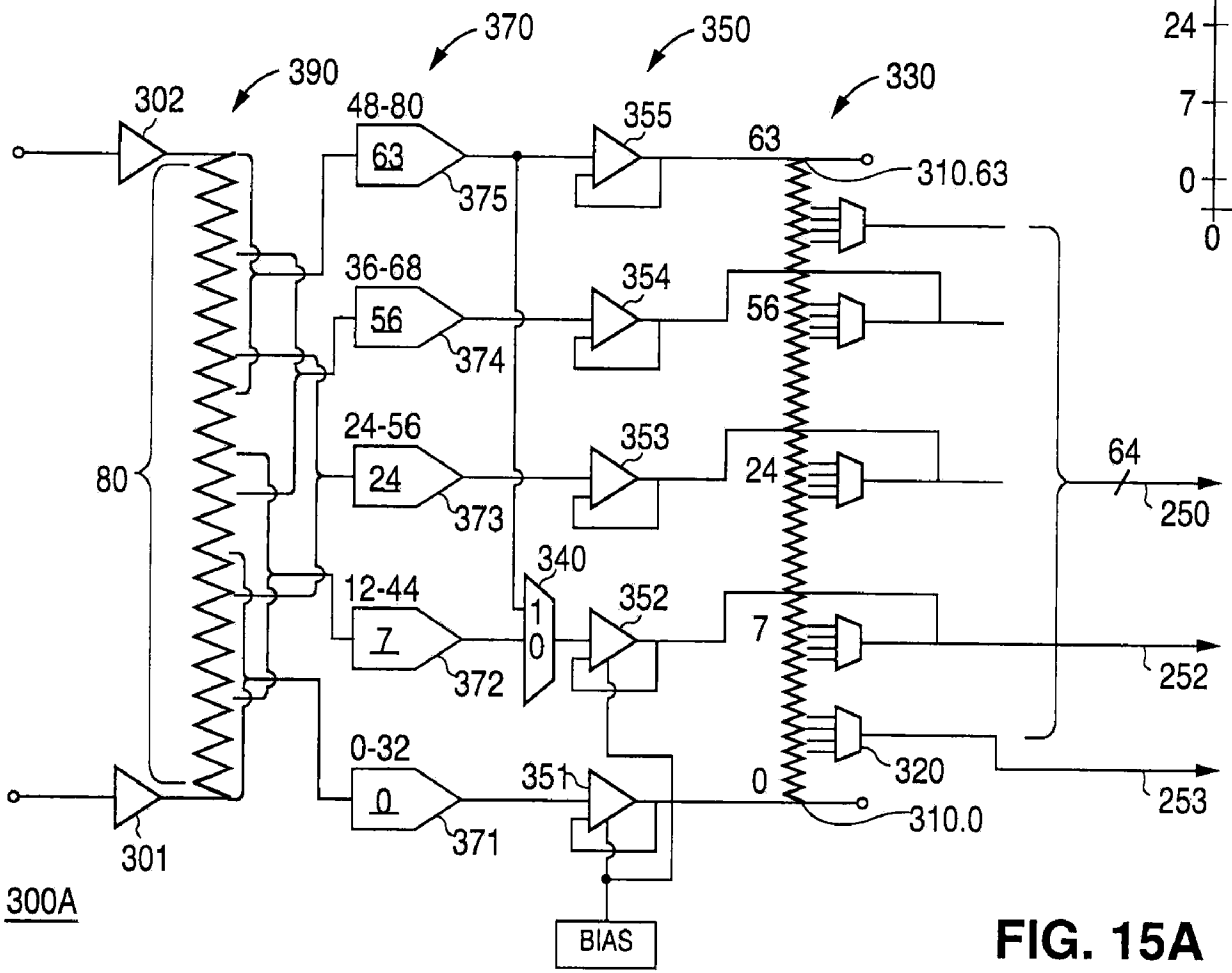
FIG. 15A is a schematic of the gamma generation circuit in the source driver block.

Inversion is accomplished by the reversal of the polarity signal in FIG. 15A. This in effect "flips" the range resistor string by applying a low voltage to the upper end and a high voltage to the lower end or vice versa. Once these voltages are changed, the voltages propagate through the gamma reference and the gamma curve is inverted without any additional circuit changes.

The operation of the GGC 300 is best explained from the reference resistor string 330 back to the input range resistor string 390. The GGC outputs sixty-four reference voltages ranging from zero ($V_{REFMIN}$) to a maximum ($V_{REFMAX}$). However, the sixty-four outputs are not linear. Those skilled in the art understand that the driving voltages for and LCD should vary non-linearly. Human perception of color is not linear and thus the reproduction of color images by LCDs must be nonlinear in order to appear acceptable to the viewer. In addition the transmissivity response of the LCD is non-linear and it too must be built into the gamma curve.

In the preferred embodiment, the decoders 60 have sixty-four reference voltages. Those reference voltages are found at taps 310.00-310.63 on the reference resistor string 330. The non-linearity is programmed into the reference resistor string 330 in several ways. First, the spacing between the taps is not equal. As such, voltage drops between sequential taps are different. Second, the reference voltages at five taps (0, 7, 24, 56, and 63) on the string 330 are driven by five operational amplifiers 350. Those amplifiers are connected to range DACs 370 that select the reference voltage from the range resistor string 390. This provides a coarse adjust of the gamma curve and allows the user to have different gamma curves on the fly for red, green, or blue, positive and negative. In effect, this is six sets of voltages.

The input range resistor string 390 has 80 taps that are equally spaced from each other. The string 390 provides a linear voltage divider of equal voltage divisions. There are five range DACs 370. Each range DAC selects one of 32 possible reference voltages available on the range resistor string 390. For example, DAC 371 may connect to any tap between 0 and 32; DAC 372 may connect to any tap in the range 12-44; DAC 373 connects to taps 24-56; DAC 374 connects to taps 36-68 and DAC 375 connects to taps 48-80. Range DACs 370 allow the user to modify the gamma output voltages of the output reference resistor string 330 by modifying the input voltages to resistor string 330. For example, the reference voltage at location 24 on the reference resistor string 330 can be adjusted by altering the tap input to range DAC 373. Of course, that will affect the voltages between locations 7 and 56. Voltages are only driven at five locations, 0, 7, 24, 56 and 63. Voltages between locations are determined by the selected location between two driven locations. For example, the voltages between locations 24 and 7 are the result of a voltage divider that has non-uniform steps between locations 24 and 7. In order to achieve this result, the outputs of 4-to-1 multiplexors 322 at locations 7, 323 at location 24 and 325 at location 56 are connected to the outputs of their respective range amplifiers, 352, 353 and 354.

The voltage drop across the range resistor string 330 varies from the high reference voltage $V_{HR}$, typically 3-5 volts, to the low reference voltage $V_{LR}$, typically ground, or zero. Although there are only 80 resistances, each DAC 370 receives thirty-two reference voltages from the range resistor string 390. As such, there is a relative large overlap of reference voltages among the DACs 370. The outputs of the DACs 370 are the break points of a four-segment non-linear curve. Those segments correspond to the four adjustable regions: 63-56, 56-24, 24-7 and 7-0. Each range DAC is individually selectable to establish a reference voltage at one of the ends of the range. DAC 375 sets voltage at level 63, DAC 374 set the voltage at level 56, DAC 373 sets the voltage at level 24, DAC 372 set the voltage at level 7 and DAC 371 set the voltage at level 0. The voltage drop from one region to the next is different and the individual steps are nonlinear.

For example, FIG. 5 displays a typical gamma curve for one color. It has 64 nominal levels. Between level 63 and level 56, the output voltage may vary by one volt. However, between level 56 and level 24, the voltage change is about 0.4 volts. Between the level 24 and level 7, the voltage changes by about 0.7 volts. Between level 7 and level 0, the change is almost two volts. Stated another way, the resistance value between tap 63 and 62 is not the same at the resistance value between the tap 62 and 61. Tapping into the reference resistor string at different and unequal locations generates the nonlinear gamma output.

The GGC of the preferred embodiment divides the gamma curve into four adjustable curve regions: 63-56, 56-24, 24-7 and 7-0. The range DAC determines one end of each region and the output taps determine the other end of the curve region. The maximum output voltage, approximately 4 volts, is at level 63 and the minimum voltage, zero, is at level 0. The voltages at levels 63, 56, 24, 7 and 0 may be configured to the display specifications.

Source Driver Circuit: Low Power Mode

The low power mode may use one bit or three bits. In the one bit mode, users often prefer to use black and white. However, it is also possible to use any color that can be created using the range of voltages that can be supplied by the DACs 375 & 371 in FIG. 15A. One color may be a background color and the other color a foreground color. It is also possible to switch from one foreground color to another. For example, when battery power is low, a manufacturer could set the gamma generator circuit to switch the foreground color from white to red and thus use the color to warn of low power in addition to a text message or low power image. In three bit mode, the sub-pixels switch differently to provide color. In the one bit mode the sub-pixels switch the same (i.e., have the same value) to provide only two colors, typically black and white.

In typical low power mode the colors are at their maximum values and one may generate red, green, blue, cyan, magenta, yellow, black and white. Three bit mode uses primary colors (red, green, or blue) or combinations of those colors. Each color may be high or low. However, a feature of the invention is that the colors may be set to less than their maximum or minimum. As such, a lighter shade of red (a voltage less than the highest possible voltage) is selectable. Selection is made by the range multiplexors 320, 321. By setting red at less than its maximum value and other colors at their maximum, the red contribution is reduced. In this way, by varying the contribution from each color, the gamma circuit is not limited to the basic combinations of red, green and blue, but rather a set of eight (in 3-bit mode) or two (in 1-bit mode) custom colors.

One of the features of the invention is its flexibility to provide optimum power in normal mode and to save power in low power mode. In normal mode, each channel (column) is individually driven by a buffer amplifier 62. However, in low power mode, the buffers 62 are shut down and the display is centrally driven by only two of the range amplifiers. During low power mode, operational amplifiers 62 in the output channels and range amplifiers 353-355 in the GGC 300 are powered down and all the gamma multiplexors 320 are disconnected. A bia circuit boosts the power to range amplifiers 351 and 352 by enough to drive the display from a central gamma reference.

In low power mode, the channel driver needs only a high and low voltage. Since only the high and low voltages are used, the reference resistor string 330 is not needed and it is effectively disconnected to save power. The low power voltages are not decoded. Instead, the analog voltage corresponding to the low power mode signal is directly connected to the multiplexors 61 in the output channels. As such, the bias block and the two range amplifiers 351, 352 power the display. A color mode multiplexor 340 is coupled to the high reference voltage 63 and to the output of the DAC 372. When color mode is selected and the device enters low power mode, the high reference voltage at location 63 is connected directly to the second range amplifier 352. Only two valid reference voltages appear and they are at locations 0 and 7 and are applied to the bus 250. Compared to other circuit traces, the circuit traces that carry voltage and current from the zero and 7 locations to the channel multiplexors 61 are larger than the rest. The larger size reduces the resistance which in turn enables the display to be driven from a central location.

Figure 16:
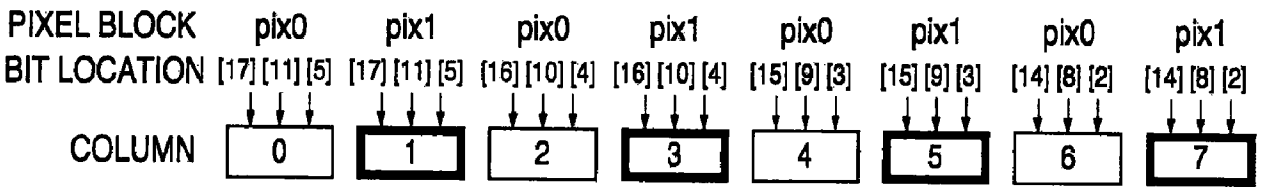

In low power three-bit mode, the channel driver performs data packing as explained above in connection with FIG. 16. Referring to FIG. 14, the tri-state switches 50 receive the three-bit data. Each color is, in effect, demultiplexed and passed to the multiplexor 61 via the LSBs that control the multiplexer via the dotted line connection 51. The gamma multiplexors 320 are powered down and this eliminates the possibility of contention during three-bit mode.

Source Driver Circuit: Manufacturer Adjustments

The 64 gamma multiplexors 320 allow the manufacturer to adjust the individual tap points of the reference resistor string 330. Each multiplexor has four or more input tap points. A select signal on the multiplexor allows the user to select desired tap points. The reason there are not 64 DACs, one for each gamma reference voltage, is that reference voltages 0 and 63 are always endpoints of the curve and are always connected to the ends of the reference resistor string.

The 64 gamma output multiplexors 320 permit further adjustment. For example, in the preferred embodiment each gamma multiplexor 320 is a 4-to-1 analog multiplexor for generating four distinct gamma curves. However, the multiplexors could be of any size, greater or smaller than the preferred embodiment, including, and not limited to, for example, 8-to-1 or 3-to 1.

Figure 15B:
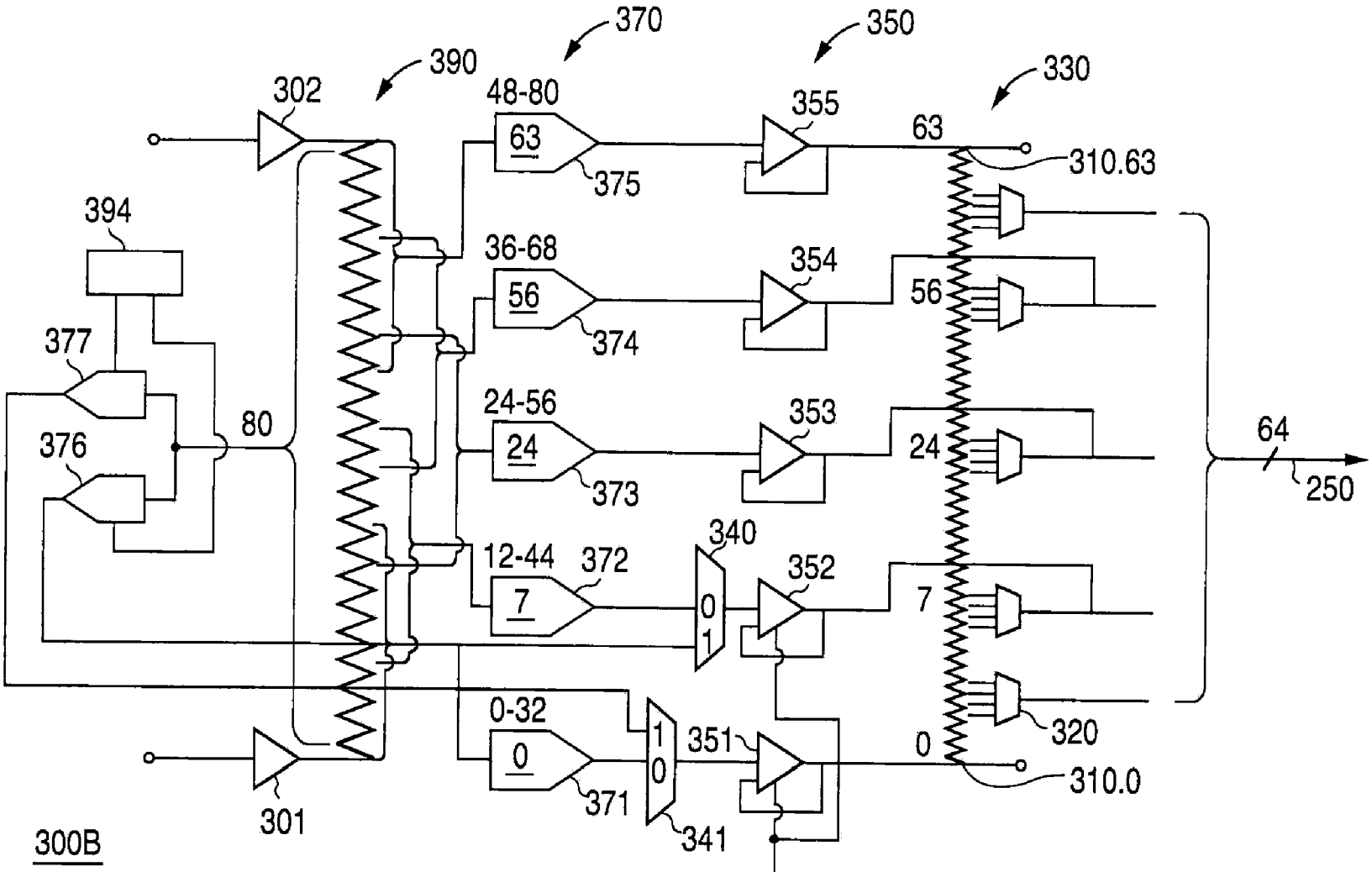
FIG. 15B is one alternate embodiment of the gamma generation circuit.

A gamma generator circuit 300B with an alternate low power color palate is shown in FIG. 15B. The GGC 300B has two 64-to-1 DACs 376, 377 connected to the range resistor string 390. Color registers in block 394 set the DACs 376, 337 to select one of the locations on the reference resistor string 390. Each DAC 376, 377 may select one of 80 voltages from the full range of the range resistor string 390. One of the DACs is set for a higher voltage and one for lower. The color register settings lets the manufacturer individually adjust the on and off intensity of each of the colors red, blue, green, to provide more colors for low power mode. In operation, control signals in the multiplexors 340, 341 select the outputs of the DACs 376, 377 and other controls shut down DACs 371-375, and range amps 353, 354, 355. Range amplifiers 351, 352 have their inputs connected to the outputs of the select multiplexors 340, 341. The amplifier outputs are connected to lines 252, 253 for directly driving the display. As explained above, the lines 252, 253 are the larger trace lines of the gamma output bus 250. Thus, only two output lines are driven in low power mode.

An alternate method provides more color resolution by adding a 64-to-1 multiplexor at the output of the reference resistor string 330 and keep the range amplifiers 350 powered up during three-bit mode. That would provide 64 output reference voltages, which could be applied directly to the pads 20. For example, one skilled in the art could leave all the gamma multiplexors powered up, use the multiplexors to select the high and low voltage for the a given color, and then directly apply the color from the gamma multiplexors to the channel drivers. One would need two additional 64-to-1 multiplexors and two buffers to drive the columns directly from the gamma reference block. This would allow a user to select a color in low power mode in a manner similar to the ability in normal mode. In effect, one could have one independent color and seven other colors dependent on the one independent color.

Figure 15C:
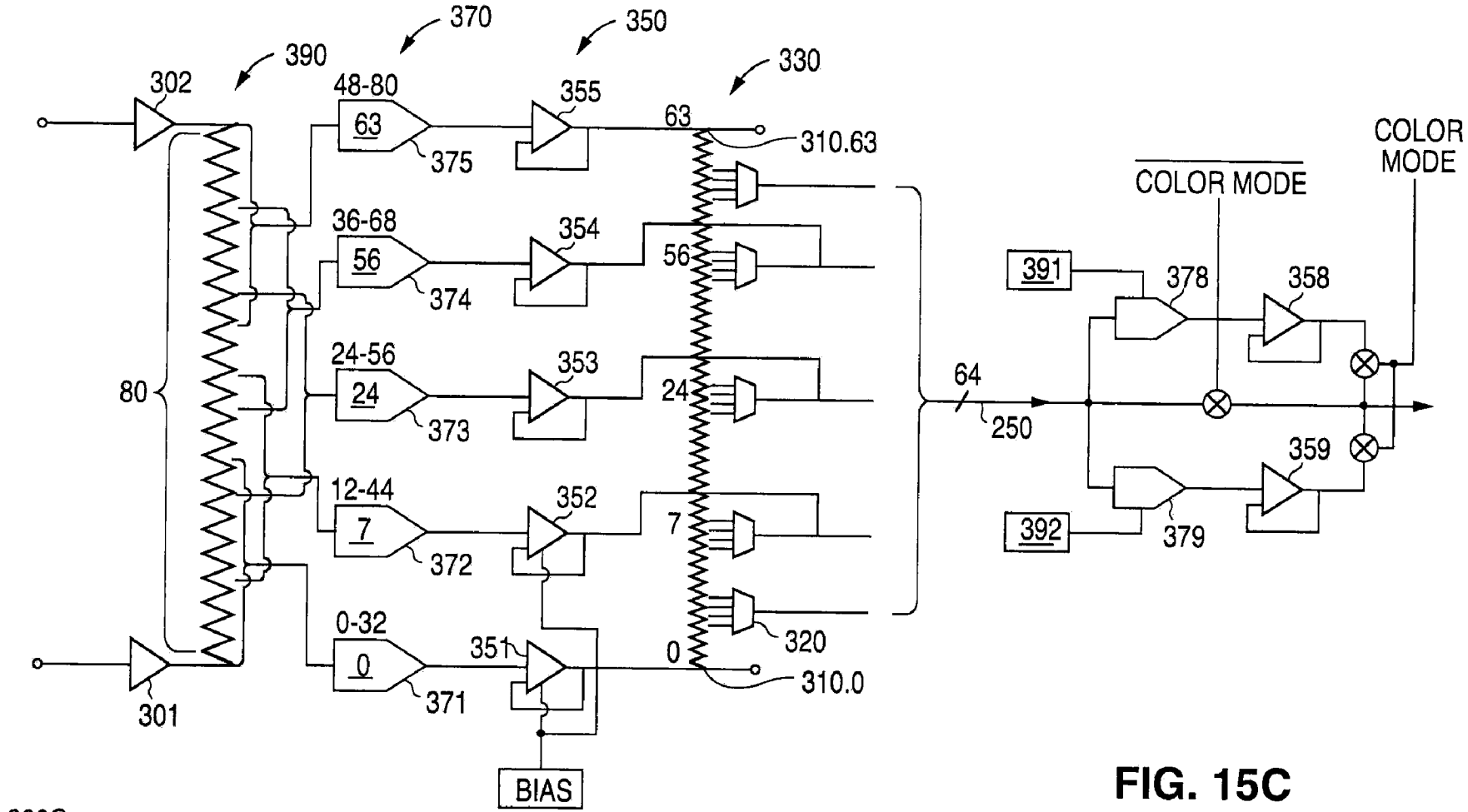
FIG. 15C is another alternate embodiment of the gamma generation circuit.

Gamma generator circuit 300C diagrams this approach and is shown in FIG. 15C. There 64-to-1 decoders 378, 379 are connected to the 64 bit output bus 250. Inputs to amplifiers 358, 359 are connected, respectively, to the outputs of the decoders 378, 379 and the amplifier outputs are connected to larger-than-normal output lines in bus 250 to drive the display. Color registers 391, 392 set the color levels in the decoders 378, 379. In operation, the entire gamma circuit 300C remains fully on. While this embodiment consumes more power, it has the added advantage of a broader selection of colors because the color selection is made from the 64 bit output of the GGC 300C.

In the embodiment of FIG. 15B the decoders 376, 377 each have 32 taps for handling five bits. However, they could handle six bits if they had 64 taps. The registers 394 select the high and low setting for each of the red, green and blue colors.

In the GGC 300C, DACs 378, 379 have a full range of color available to it in contrast to the limited range available in GGC 300A. Likewise, in GGC 300C, its decoders 378, 379 also have a full range of color.

Figure 18:
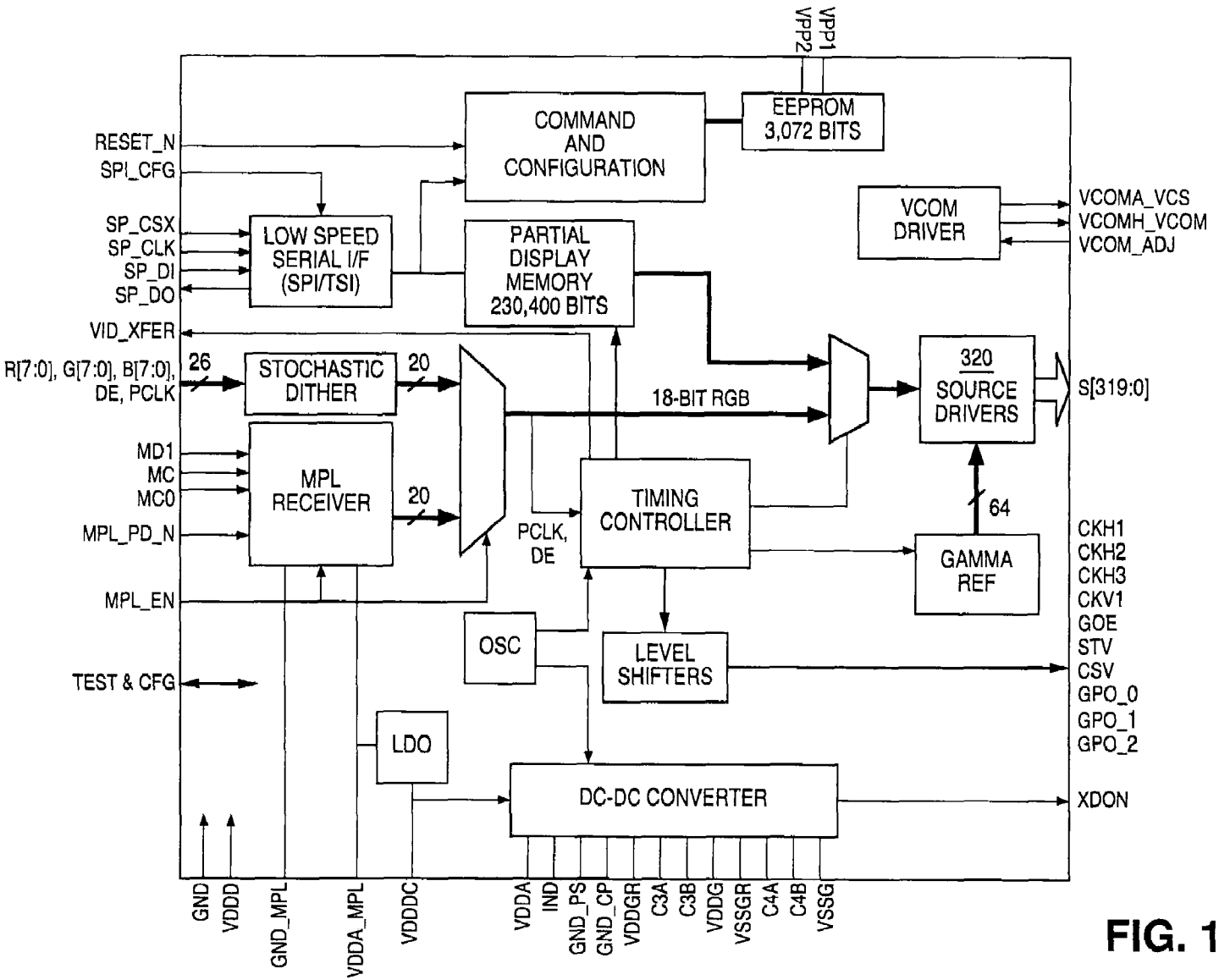
FIG. 18 is a block diagram of a commercial embodiment of a video display driver system for displaying video according to an embodiment of the present invention.

Referring to FIG. 18, in accordance with an embodiment of the presently claimed invention, a commercial product of the assignee, National Semiconductor Corporation, includes a command and configuration stage, a low-speed serial interface (LoSSI), a partial display memory, a video interface, a MPL receiver, an EEPROM, a timing controller, level shifters, an oscillator, a DC-DC converter, a source driver, a gamma reference and a $V_{COM}$ driver, interconnected substantially as shown.

The Command and Configuration block contains the Command Interpreter and Configuration Registers which control the functions, settings, and operating modes of the device. There are two methods that may be used to control the device and modify the Configuration Registers. In Command Mode, OpCodes received from the LoSSI Interface cause mode changes or changes to the Configuration Registers based on the OpCode received and the "command profile" stored in the EEPROM. Device control using the Command Mode is beneficial in that it allows the host processor display driver software to be display independent. In Register Access Mode, the LoSSI Interface directly accesses the Configuration Registers. Upon assertion of hardware reset (RESET_N pin), the device is placed in the Command Mode. Register Access Mode can be selected from the LoSSI interface by issuing the Enter Register Access Mode command. Command Mode can be selected from the LoSSI interface by issuing the Enter Command Mode OpCode.

The LoSSI interface is used for several functions: send commands; access the Configuration Registers; and send data to the Partial Display Memory. The LoSSI interface uses either the SPI or TSI protocol as determined by the state of the SPI_CFG pin. The LoSSI interface signals use CMOS logic levels (GND, $V_{DDD}$). The LoSSI interface includes four signals: SP_CSX (chip select input) is low-active; SP_CLK (serial clock input) is the data transfer synchronization signal, may operate at speeds up to 10 MHz during register writes or command operations, or up to 6.6 MHz during register read operations, and should be set high when idle; SP_DI (serial data input) is the serial data input pin and is sampled at the rising edge of SP_CLK; and SP_DO (serial data output) is the serial data output pin and is held in a high-impedance state except when data is being driven out during read operations. The SP_DI and SP_DO signals may be tied together if the host processor supports bi-directional data transfer. Two protocols are supported across the LoSSI interface: an 8-bit protocol (SPI protocol) and a 9-bit protocol (TSI protocol) which includes an extra bit at the beginning of each transaction. The SPI protocol is selected by connecting the SPI_CFG pin to VDD.

The extra bit in the TSI protocol (Data/Command or D/CX) is useful in Command Mode to identify the subsequent 8-bits as either a command or data field. This can be helpful to recover from a partially completed command argument transfer. For example, this condition might occur if a host interrupt occurs while transferring image data to the Partial Display Memory. If the TSI protocol is utilized, it is possible to terminate an in-process transaction and abort the transfer of the remaining data. Then after processing the interrupt, the remaining data can be sent to the Partial Display Memory without re-issuing the command and previously sent data by identifying the transaction as a data transfer as opposed to a command. Alternatively, if the SPI protocol is used, it is still possible to service an interrupt and suspend data transfer as long as the LoSSI chip-select (SP_CSX) and clock signal (SP_CLK) are held in their current state until data transfer can resume.

The Partial Display Memory block is used to store image data for local refresh of the display. It can be used as the sole video source in Partial Mode or its contents can be blended with (or overlaid on) the incoming video data in Alpha Mode. While operating in Partial Mode, system power is greatly reduced because the video controller in the system may be shut down. In this mode, image data is read from the Partial Display Memory and used to refresh the display. All display refresh timing is derived from an internal oscillator, thus no external video signals are required. In Alpha Mode, the Partial Display Memory contents can be used as a transparent text or border overlay on the incoming video data. It is also possible to blend the contents of the Partial Display Memory to add full-color logos and other effects to the video data. The Partial Display Memory contains 230,400 bits of memory. This size is sufficient to display an 80×320 window of 3-bit data, or any equivalent size in terms of the total pixels contained in the Partial Display Window multiplied by the color depth of each pixel. In Register Access Mode, image data should be streamed in raster-order into the Partial Display Memory by writing data to the RAM_PORT register as described in the next sections. In Command Mode, the Memory Write command is used to send image data to the Partial Display Memory.

During Partial Mode, pixel data is read from the Partial Display Memory and displayed in a rectangular Partial Display Window as shown in FIG. 11. Regions outside this window are blanked to minimize power. The color of the blanked regions is specified in the Partial Mode Border Color registers. The raster always begins at the starting row and starting column. The column is incremented first thus, the raster is filled from left to right and then from top to bottom.

Supported color depths for the Partial Display Window include 1-bit, 3-bit, 12-bit and 18-bit. In Command Mode, the color depth is set via the PM Color Set command (EEh OpCode). In Register Access Mode, the Partial Display Window color depth is controlled by the BITS_PER_PIXEL register. The maximum size of the Partial Display Window is related to the number of bits in the Partial Display Memory and to the color depth setting. The Partial Display Memory can fill a complete 320×560 screen for 1-bit color depth operation, 76,800 3-bit pixels (e.g. 240×320×3-bit window), 19,200 12-bit pixels (120×160×12-bit window) and 12,800 pixels in 18-bit color depth operation (128×100×18-bit window). The window size for the partial display window can be doubled in both dimensions through the use of an upscale feature. In order to maximize the useable memory for each color depth, the image data is packed into the Partial Display Memory based on the color depth setting. It is then unpacked to the current color depth setting as it is read out for Partial Display refresh. Therefore, if the size or color depth of the Partial Display Window is changed, the Partial Display Memory is reloaded with updated image data corresponding to the new window settings. There is also a relationship between the Partial Mode color depth setting and the pixel data packing on the LoSSI interface as is illustrated in FIG. 5.

A pixel scaling function enables incoming video or image data stored in the Partial Display Memory to be up-scaled by a factor of 2 in both the x-dimension and y-dimension. In this manner, a single pixel is mapped into a 2×2 cluster of pixels.

The number of pixels sent correspond to a whole number of bytes. Accordingly, dummy pixels may be sent, so long as the total number of pixels sent does not exceed the capacity of the memory. Preferably, the Partial Display Memory word size is fixed. To efficiently use the available bits in the Partial Display Memory, the pixel data is packed into the fixed memory word size. Incoming pixel data is not written into the memory until all the bits of the memory word have been filled. Therefore, it may be necessary to pad extra bits onto the end of the data stream so that the data stream contains an integral multiple of 36 bits.

The Timing Controller block generates the timing signals required to load data into the source driver and controls the scanning of the display. The display may be operated in one of three modes: Normal Mode, Partial Mode or Alpha Mode. In Normal Mode, the display scan timing is developed from the DE and PCLK signals and the video data stream. The data displayed is obtained from the video data stream. In Partial Mode, the display is self-refreshed by the Timing Controller block using the on-chip Oscillator block as the clock source. The data sent to the display is read from the internal Partial Display Memory. In Alpha Mode, the display scan timing is also developed from the DE and PCLK signals, and data obtained from the video stream is displayed in the background. In addition, data is read from the internal Partial Display Memory and displayed in a partial display window in the foreground. Within this window, the foreground and background may be blended in one of four ratios: 25% foreground+75% background; 50% foreground+50% background; 100% foreground; or Transparent foreground (OSD function).

The Timing Controller block is designed to interface with many configurations of LTPS/CGS glass: single-phase or two-phase vertical clocking; RGB or BGR subpixel ordering for horizontal scanning; timing pulse widths and non-overlap times which are register-adjustable to optimize display settling performance; polarity and phasing of glass signals controlled via register settings; and vertical timing relationships associated with various configurations of dummy lines on the glass controlled by register settings.

The Timing Controller block has ten outputs that are designed to control the display refresh and scanning. The Level Shifter block performs logic level translation for these signals such that they can interface properly to the glass control inputs. The output voltage for the level shifter signals is $V_{SSG}$ to $V_{DDG}$. There are 3 outputs (GPO_0, GPO_1, GPO_2) whose signal function changes depending on the setting of the GPO register. All level shifter outputs are driven to GND when in the Sleep state.

An additional level-shifted output XDON is provided by the DC-DC converter block. Normally, XDON is at the $V_{SSG}$ level whenever $V_{DDDC}$ is present. If $V_{DDDC}$ is suddenly interrupted, XDON immediately goes to the $V_{DDG}$ level. Because there is external capacitance on the $V_{DDG}$ and $V_{SSG}$ nodes, XDON will persist at the $V_{DDG}$ level for a brief period of time after $V_{DDDC}$ is interrupted. Thus, XDON may be reliably used by the glass as a control signal to discharge all nodes on the glass in the event of a sudden power interruption.

The on-chip oscillator generates a 13.5 MHz internal clock signal (OSC). The OSC signal is used as the clock source for the Timing Controller block during Partial Mode and during certain command sequences such as the power-down sequence.

The Source Driver block converts the digital image data received from the MPL interface or Partial Display Memory to analog voltages required to drive the source lines on the glass. The source driver block consists of 320 drive channels. Each drive channel receives RGB data for one pixel and performs a D/A conversion of the red, green and blue data in a time-multiplexed sequence that is synchronized to the glass multiplex select signals (CKH1-3). The conversion sequence of the RGB data within each line time is determined by the SCAN register settings. The SCAN[1] register bit controls the data loading direction of the Source Driver block, S0→S319 or S319→S0 direction. For display applications in which the pixels/line on the glass is less than 320 channels, the COL_OFFSET register can be used to specify which outputs are active and which outputs are unused by the application. This can help optimize the source line fan-out region between the driver and the glass active region. The COL_OFFSET is specified in conjunction with the SCAN[1] setting. If the load direction is set for the S0→S319 direction, then the COL_OFFSET is referenced to the S0 output. If the load direction is set for the S319→S0 direction, then the COL_OFFSET is referenced with respect to the S319 output. The voltage transfer characteristic of the source driver DAC is determined by the 64 gamma reference voltages generated by the Gamma Reference block. The drive strength for the source driver output is also programmable to optimum settling and power performance via the GAMMA_CFG1[4:0] register bits.

Four intrinsic gamma curves are available for the 64 reference voltages. The intrinsic curves can be used to accomplish various goals for the module user. One goal might be to obtain matching optical performance from various module suppliers. It is even possible to optimize the individual curve shapes for the different color channels of a given supplier. In these cases, the four curve options can be optimized for each of the module supplier's glass characteristics and the selection of the proper curve and settings is included in the SLEEP_OUT command. The GAMMA_SET command is not used in this case as the other choices are optimized for a different module supplier. Another reason for using multiple intrinsic curve settings might be to provide multiple gamma characteristics (e.g. $\gamma$=1.0, 1.8, 2.2, 2.5) for a given module in order to optimize performance for various viewing conditions and applications. In this case, the various curves can be selected via the Gamma Set command or through direct register access to Gamma Register settings.

Figure 19A:
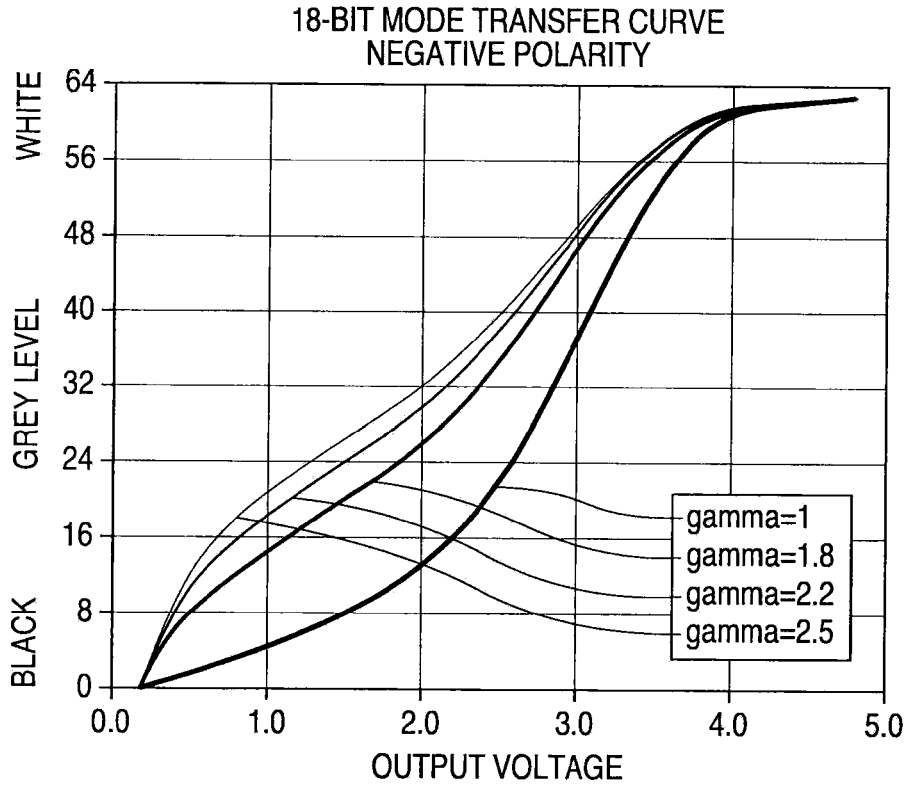
FIGS. 19A and 19B illustrate possible negative and positive gamma polarity curves, respectively.
Figure 19B:
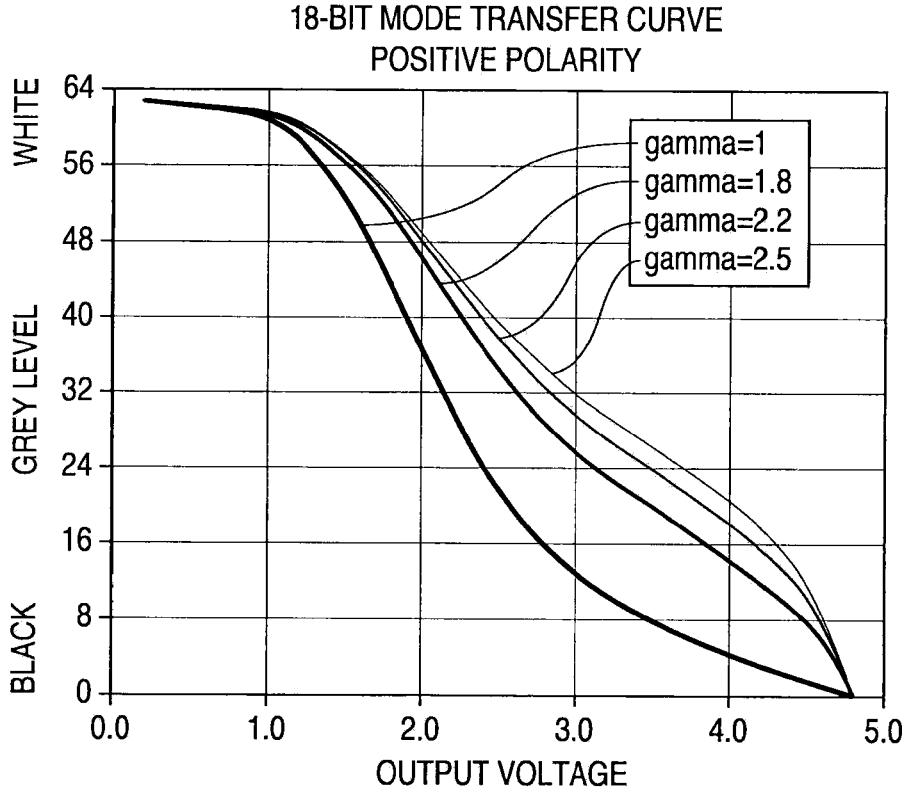

Referring to FIGS. 19A and 19B, which illustrate possible negative and positive intrinsic curve shapes, respectively, after selecting the intrinsic curve which most closely matches the desired characteristic, the curve shape can then be optimized to better match the desired characteristic through the use of the gamma register settings. The shape and gamma labels in these figures are for illustration purposes only. The GAMMA_CFG1[7] register bit determines whether one of these four shapes is used with all three color channels or if separate curves or adjustment settings are selected for each color channel. This same intrinsic shape may be used for the green and blue curves with different optimization settings (see below discussion of optimization settings), or different intrinsic shapes and optimization settings may be chosen for each color channel. For a given color channel, the same intrinsic curve shape will be used for both drive polarities.

Figure 21:
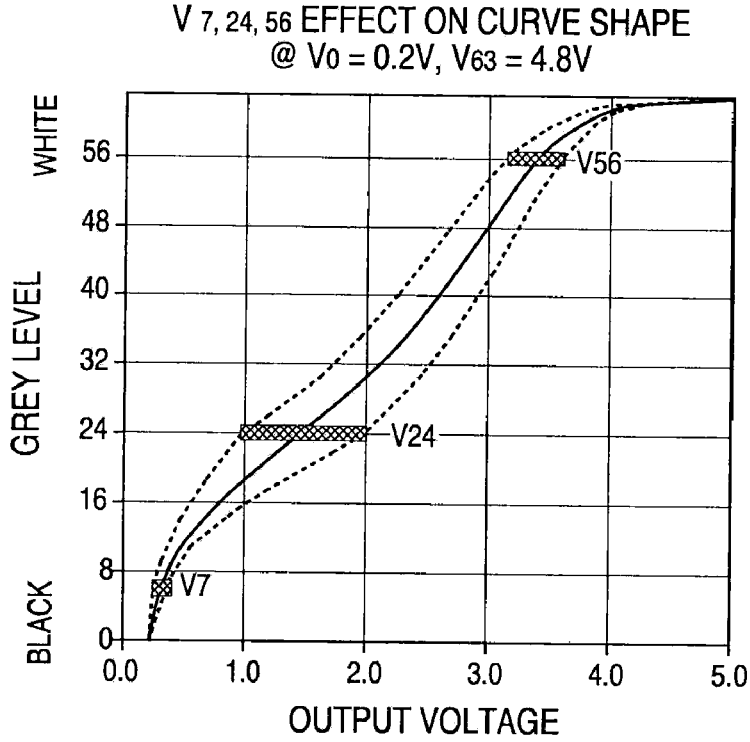
FIG. 21 illustrates a gamma curve adjustment according to an embodiment of the present invention.

Referring to FIG. 20, values can be generated in accordance with equations for four intrinsic gamma curves as shown. Referring to FIG. 21, the selected intrinsic curve shape may be optimized by setting the voltage values of the endpoints (V0 and V63) and of three taps (V7, V24 and V56) via range adjustment DACs (referred to as Range DACs). According to an example embodiment, the settings for the positive polarity gamma curve are independent from those for the negative polarity gamma curve, though the same intrinsic curve shape will be used for both drive polarities. The voltages for V0, V7, V24, V56 and V63 are determined by the $V_{GR}$ reference voltage which is adjustable to match the curve dynamic range by the VDD_ADJ[7:5] register bits and the Gamma Reference registers. The settings for VDDA and VGR in the VDD_ADJ register should be determined as follows: calculate VGR setting required base upon the most positive value of VcomH, VcomA, V0+ or V63− using predetermined relationships; and calculate the value of VDDA from the maximum value for VGR, VDDGR, VSSGR plus operating voltage headroom.

Figure 22:
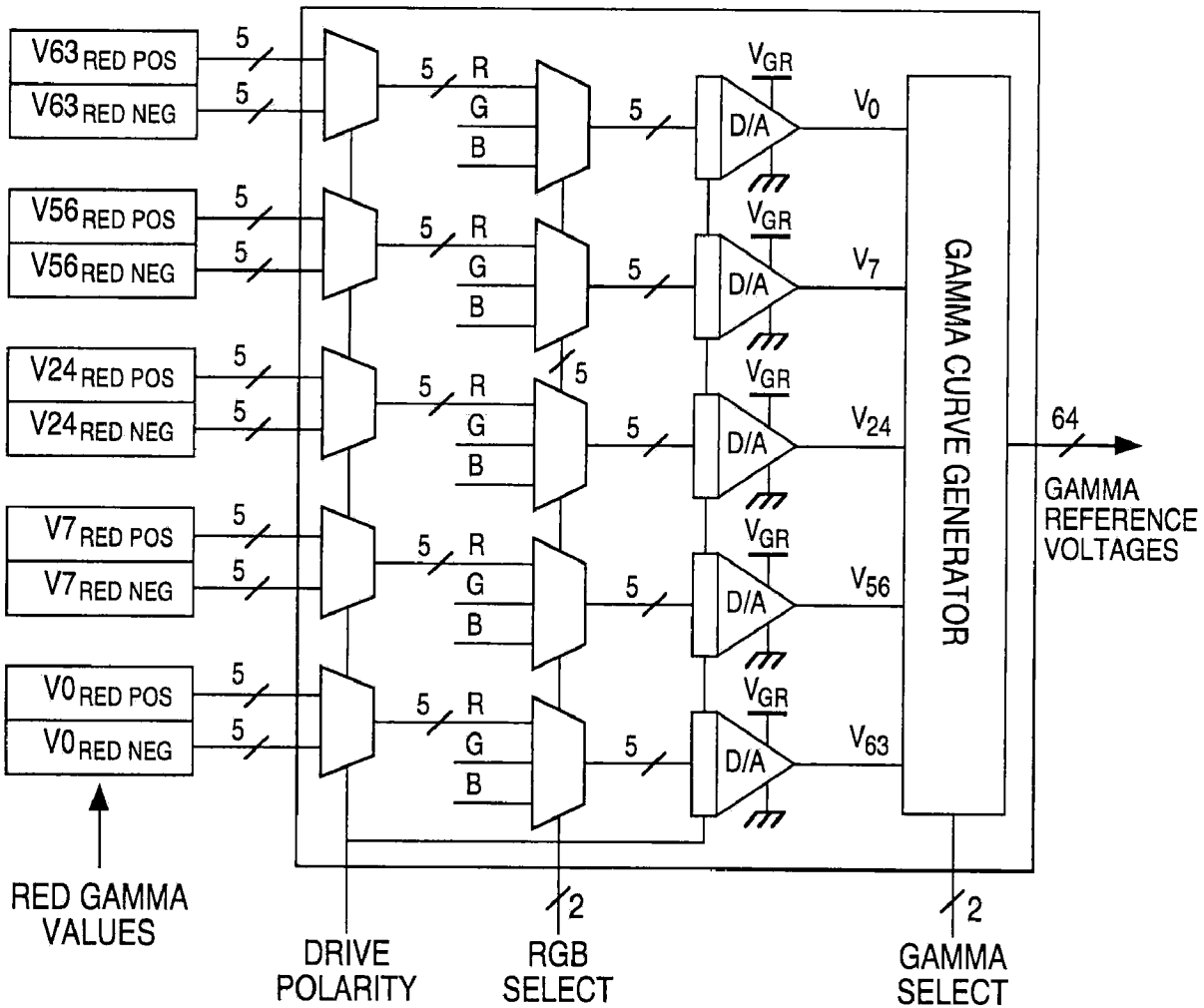
FIG. 22 is a block diagram of a gamma reference architecture according to an embodiment of the present invention.

Referring to FIG. 22, the architecture of the Gamma Reference block can be implemented as shown (for simplicity, only the Range DAC optimization registers for the red channel are shown). The DRIVE POLARITY signal is provided by the Timing Controller and does two things: select the adjustment values for either the negative or for the positive drive polarities, for each of the colors (green and blue registers are not shown); and select the correct output voltage ranges for the D/A converters. For negative drive polarity, the D/A for $V_0$ will generate a voltage near ground, and the D/A for $V_{63}$ will generate a voltage near $V_{GR}$ (FIG. 19A). For positive drive polarity, the D/A for $V_0$ will generate a voltage near $V_{GR}$, and the D/A for $V_{63}$ will generate a voltage near ground (FIG. 19B). If GAMMA_CFG1[7]=0, the RGB select signals will always select the values corresponding to the red channel. If GAMMA_CFG1[7]=1, the RGB select signals from the Timing Controller select the red, green or blue gamma values according to the CKH1, CKH2 and CKH3 clocks and the RGB/BGR select bits (SCAN[7] and SCAN [0]).

Figure 23:
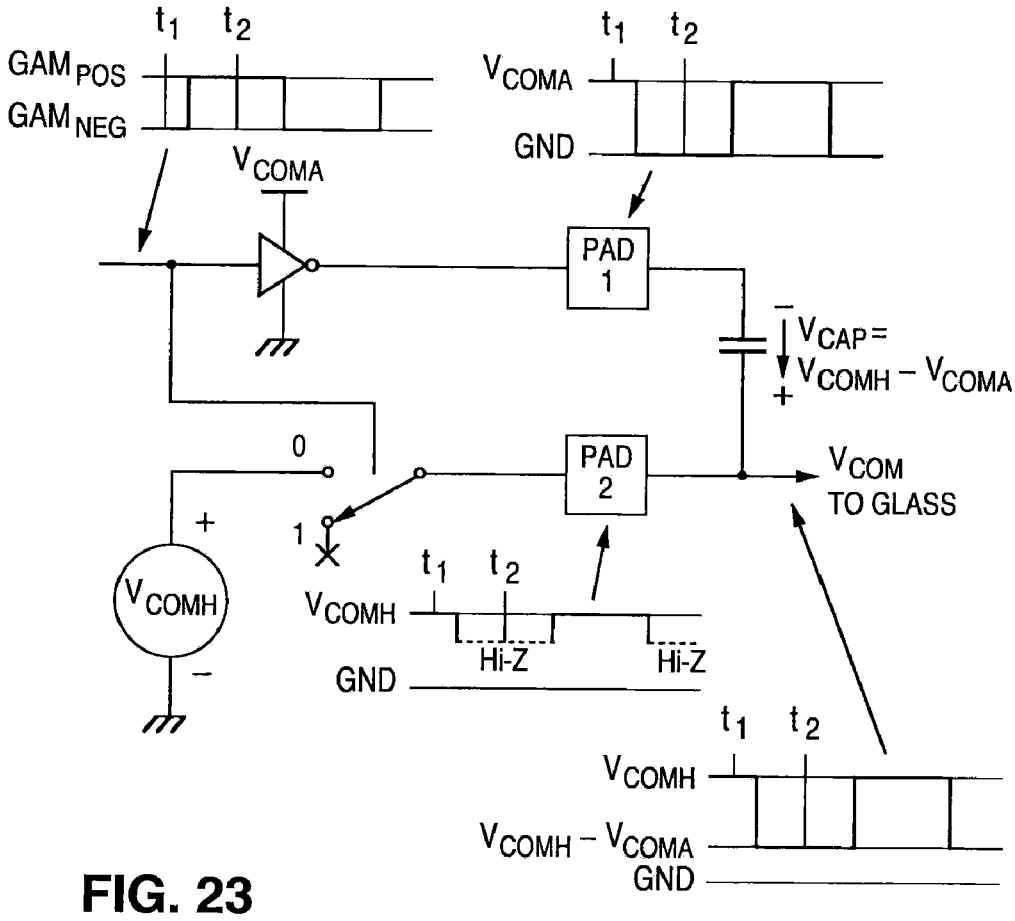
FIG. 23 is a block diagram of an AC $V_{COM}$ circuit according to an embodiment of the present invention.

Referring to FIG. 23, DC $V_{COM}$ or AC $V_{COM}$ drive may be selected by the VCOM_ADJ[7] register bit. The AC VCOM drive scheme utilizes two device pins and an external coupling capacitor. In this mode, the VCOMA_VCS pin (Pad 1) is functioning to output the VCOMA signal to the coupling capacitor. The second device pin, VCOMH_VCOM (Pad 2), is functioning to establish the dc value of the $V_{COM}$ node during the high time of the waveform. The AC $V_{COM}$ Mode is selected by setting VCOM_ADJ[7]=1. The $V_{COM}$ AC signal is provided at the VCOMA_VCS pads. The amplitude of this signal is set by the VCS_ADJ register.

The VCOMH_VCOM output is used to clamp the $V_{COM}$ high level, and should be connected directly to the $V_{COM}$ line to the glass. If VCOM_ADJ[6]=0, this high level is determined by VCOM_ADJ[5:0]. If VCOM_ADJ[6]=1, this high level is adjusted by an external voltage connected to the VCOM_ADJ pin. The VCOMH_VCOM pads should be connected directly to the $V_{COM}$ input of the glass, and the VCOMA_VCS pads should be connected through a large capacitor to the $V_{COM}$ input to the glass.

During time $t_1$, pad 1 (VCOMA_VCS signal) is driven to the voltage $V_{COMA}$ and pad 2 (VCOMH_VCOM signal) is driven to the voltage $V_{COMH}$. As a result, the $V_{COM}$ voltage to the glass will be equal to $V_{COMH}$ and the external capacitor will be charged to a voltage of ($V_{COMH}$-$V_{COMA}$). During time $t_2$, pad 1 is driven to ground and pad 2 is floating. Because the external capacitor remains charged to a voltage of ($V_{COMH}$-$V_{COMA}$), the voltage on pad 2 (the $V_{COM}$ signal to the glass) will be also equal to ($V_{COMH}$-$V_{COMA}$). Thus, the $V_{COM}$ voltage applied to the glass will swing between $V_{COMH}$ and ($V_{COMH}$-$V_{COMA}$).

The DC $V_{COM}$ Mode is selected by setting VCOM_ADJ [7]=0. In this case the DC $V_{COM}$ voltage to the glass is provided by the VCOMH_VCOM output. The $C_{STORE}$ voltage to the glass (VCS) is provided by the VCOMA_VCS output. The DC level of VCOMA_VCS is set by the VCS_ADJ register.

Flicker is minimized by setting the VCOMH_VCOM level either by changing the VCOM_ADJ[5:0] register or by adjusting an external voltage connected to the VCOM_ADJ pin. If the register method is used, then the optimized value for the VCOM_ADJ register should be included in the Sleep Out initialization profile in the EEPROM such that the register is always set to the optimized value during the power-up sequence. Alternatively, if multiple gamma curves and Vcom settings are used in the operation of the device, the optimized VCOM_ADJ setting can be included in the appropriate Gamma Set command profile. In this manner, it is possible to optimize flicker independently for each Gamma Curve selection.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A method for using a data enable signal and pixel clock exclusive of their associated horizontal and vertical synchronization signals for a digital video signal to facilitate generating of signals corresponding to said associated horizontal and vertical synchronization signals, comprising:

receiving a pixel clock having a plurality of periodic clock pulses;

receiving a data enable signal with asserted and de-asserted states separated by leading and trailing signal edges;

counting first and second portions of said plurality of pixel clock pulses corresponding to time intervals between unlike ones and like ones of said leading and trailing signal edges to produce at least first and second pixel clock counts, respectively;

comparing respective ones of said plurality of first pixel clock counts to produce a first comparison count with a first learned value indicative of a difference between first and second ones of said plurality of first pixel clock counts;

comparing respective ones of said plurality of second pixel clock counts to produce a second comparison count with a second learned value indicative of a difference between first and second ones of said plurality of second pixel clock counts; and counting each one of a plurality of successive portions of said plurality of pixel clock pulses through a count equal to said second learned value in a succession of pixel counts to produce a pixel count signal indicative of a horizontal line interval, and a total line signal indicative of a vertical line interval.

2. The method of claim 1, wherein said counting first and second portions of said plurality of pixel clock pulses corresponding to time intervals between unlike ones and like ones of said leading and trailing signal edges to produce at least first and second pixel clock counts, respectively, comprises:

counting a plurality of portions of said plurality of pixel clock pulses corresponding to respective time intervals between successive unlike ones of said leading and trailing signal edges to produce a plurality of first pixel clock counts; and counting a plurality of portions of said plurality of pixel clock pulses corresponding to respective time intervals between successive like ones of said leading and trailing signal edges to produce a plurality of second pixel clock counts.

3. The method of claim 2, wherein said counting a plurality of portions of said plurality of pixel clock pulses corresponding to respective time intervals between successive unlike ones of said leading and trailing signal edges to produce a plurality of first pixel clock counts comprises counting a plurality of portions of said plurality of pixel clock pulses corresponding to a plurality of one of said asserted and de-asserted states of said data enable signal.

4. The method of claim 2, wherein said counting a plurality of portions of said plurality of pixel clock pulses corresponding to respective time intervals between successive like ones of said leading and trailing signal edges to produce a plurality of second pixel clock counts comprises counting a plurality of portions of said plurality of pixel clock pulses corresponding to successive ones of said asserted and de-asserted states of said data enable signal.

5. The method of claim 1, wherein:

said comparing respective ones of said plurality of first pixel clock counts to produce a first comparison count with a first learned value related to a difference between first and second ones of said plurality of first pixel clock counts comprises comparing first and second successive ones of said plurality of first pixel clock counts to produce a first comparison count, wherein said first comparison count has a value which changes from a first prior value and to a first learned value corresponding to said second one of said plurality of first pixel clock counts when said first and second ones of said plurality of first pixel clock counts are equal; and said comparing respective ones of said plurality of second pixel clock counts to produce a second comparison count with a second learned value related to a difference between first and second ones of said plurality of second pixel clock counts comprises comparing first and second successive ones of said plurality of second pixel clock counts to produce a second comparison count, wherein said second comparison count has a value which changes from a second prior value and to a second learned value corresponding to said second one of said plurality of second pixel clock counts when said first and second ones of said plurality of second pixel clock counts are equal.

6. The method of claim 5, wherein said comparing first and second ones of said plurality of first pixel clock counts to produce a first comparison count comprises comparing successive ones of said plurality of first pixel clock counts.

7. The method of claim 5, wherein said comparing first and second ones of said plurality of second pixel clock counts to produce a second comparison count comprises comparing successive ones of said plurality of second pixel clock counts.

8. The method of claim 1, wherein said counting each one of a plurality of successive portions of said plurality of pixel clock pulses through a count equal to said second learned value in a succession of pixel counts to produce a pixel count signal indicative of a horizontal line interval, and a total line signal indicative of a vertical line interval further includes producing:

a vertical count signal indicative of a first portion of said succession of pixel counts during which said data enable signal includes one of said asserted and de-asserted states, and a second portion of said succession of pixel counts during which said data enable signal includes both of said asserted and de-asserted states; and an active line signal indicative of said second portion of said succession of pixel counts.

* * * * *